US011385588B2

(12) United States Patent
Nozaki et al.

(10) Patent No.: US 11,385,588 B2
(45) Date of Patent: Jul. 12, 2022

(54) SHEET LAMINATOR, IMAGE FORMING APPARATUS, AND IMAGE FORMING SYSTEM

(71) Applicant: Ricoh Company, Ltd., Tokyo (JP)

(72) Inventors: Wataru Nozaki, Kanagawa (JP); Tomohiro Furuhashi, Kanagawa (JP); Wataru Takahashi, Tokyo (JP); Sho Asano, Kanagawa (JP); Yoshito Suzuki, Chiba (JP); Shinya Monma, Kanagawa (JP); Joji Akiyama, Kanagawa (JP); Yohsuke Haraguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/357,108

(22) Filed: Jun. 24, 2021

(65) Prior Publication Data

US 2021/0405571 A1 Dec. 30, 2021

(30) Foreign Application Priority Data

Jun. 29, 2020 (JP) ..... JP2020-111643

(51) Int. Cl.
*G03G 15/00* (2006.01)

(52) U.S. Cl.
CPC ..... *G03G 15/6582* (2013.01); *G03G 15/6585* (2013.01); *G03G 15/6588* (2013.01); (Continued)

(58) Field of Classification Search
CPC ..... G03G 15/6582; G03G 15/6585; G03G 15/6588; G03G 15/6591; G03G 2215/00801; G03G 2215/00805
See application file for complete search history.

(56) References Cited

U.S. PATENT DOCUMENTS

2002/0135791 A1* 9/2002 Rodriquez ..... G03G 15/6552 358/1.12
2013/0323479 A1* 12/2013 Kobayashi ..... G03G 7/0046 428/212

(Continued)

FOREIGN PATENT DOCUMENTS

JP 9-164593 6/1997
JP 2006-160429 6/2006

*Primary Examiner* — Joseph S Wong
(74) *Attorney, Agent, or Firm* — Xsensus LLP

(57) ABSTRACT

A sheet laminator includes a sheet separation device, a sheet insertion device, and circuitry. The sheet separation device is configured to perform a sheet separating operation to separate a non-bonding portion of a two-ply sheet in which two sheets are overlapped and bonded together at a bonding portion of the two-ply sheet, and a sheet inserting operation to insert an inner sheet between the two sheets. The sheet lamination device is configured to perform a sheet laminating operation on the two-ply sheet after the sheet separating operation and the sheet inserting operation. The circuitry is configured to cause the sheet lamination device to perform the sheet laminating operation on the two-ply sheet while causing the sheet separation device to perform the sheet separating operation on another two-ply sheet subsequent to the two-ply sheet or the sheet separating operation and the sheet inserting operation on said another two-ply sheet.

9 Claims, 16 Drawing Sheets

(52) U.S. Cl.
CPC ..... *G03G 15/6591* (2013.01); *G03G 2215/00801* (2013.01); *G03G 2215/00805* (2013.01)

(56) References Cited

U.S. PATENT DOCUMENTS

| | | | |
|---|---|---|---|
| 2018/0257900 | A1 | 9/2018 | Suzuki et al. |
| 2019/0010011 | A1 | 1/2019 | Watanabe et al. |
| 2019/0276263 | A1 | 9/2019 | Hidaka et al. |
| 2019/0284008 | A1 | 9/2019 | Sakano et al. |
| 2019/0284009 | A1 | 9/2019 | Suzuki et al. |
| 2019/0284010 | A1 | 9/2019 | Asami et al. |
| 2019/0284011 | A1 | 9/2019 | Furuhashi et al. |
| 2019/0284012 | A1 | 9/2019 | Yoneyama et al. |
| 2019/0367317 | A1 | 12/2019 | Haraguchi et al. |
| 2020/0140222 | A1 | 5/2020 | Takahashi et al. |
| 2020/0239265 | A1 | 7/2020 | Suzuki et al. |
| 2020/0247107 | A1 | 8/2020 | Morinaga et al. |
| 2020/0247636 | A1 | 8/2020 | Furuhashi et al. |
| 2020/0270093 | A1 | 8/2020 | Suzuki et al. |
| 2020/0338877 | A1 | 10/2020 | Takahashi et al. |
| 2020/0341414 | A1 | 10/2020 | Watanabe et al. |
| 2020/0385231 | A1 | 12/2020 | Kunieda et al. |
| 2020/0407187 | A1 | 12/2020 | Hidaka et al. |
| 2021/0039900 | A1 | 2/2021 | Shimazu et al. |
| 2021/0039916 | A1 | 2/2021 | Sugiyama et al. |

* cited by examiner

| |
|---|
| FIG. 13A |
| FIG. 13B |

SHEET LAMINATOR, IMAGE FORMING APPARATUS, AND IMAGE FORMING SYSTEM

CROSS-REFERENCE TO RELATED APPLICATION

This patent application is based on and claims priority pursuant to 35 U.S.C. § 119(a) to Japanese Patent Application No. 2020-111643, filed on Jun. 29, 2020, in the Japan Patent Office, the entire disclosure of which is hereby incorporated by reference herein.

BACKGROUND

Technical Field

Embodiments of the present disclosure relate to a sheet laminator that performs a sheet lamination on a two-ply sheet in which an inner sheet is inserted, an image forming apparatus (for example, a copier, a printer, a facsimile machine, and a multi-functional apparatus having at least two functions of the copier, the printer, and the facsimile machine) including the sheet laminator, and an image forming system including the sheet laminator.

Background Art

Various types of sheet laminators are known to perform the sheet laminating operation on a two-ply sheet in which two sheets are bonded together at a bonding portion on one end of the two-ply sheet after the two sheets of the two-ply sheet are separated and an inner sheet is inserted into the two-ply sheet with the two sheets being separated.

Specifically, a known sheet laminator separates two sheets of a laminated sheet (that is a two-ply sheet) in which one sides of the two sheets are bonded at one end of the two-ply sheet, and inserts protective paper that is an inner sheet between the two sheets. Then, the lamination sheet in which the protective paper is inserted is conveyed to a portion (lamination portion) in which a heater is disposed, so that the heater heats the lamination sheet to perform the sheet lamination.

SUMMARY

Embodiments of the present disclosure described herein provide a novel sheet laminator including a sheet separation device, a sheet insertion device, and circuitry. The sheet separation device is configured to perform a sheet separating operation to separate a non-bonding portion of a two-ply sheet in which two sheets are overlapped and bonded together at one end as a bonding portion of the two-ply sheet, and a sheet inserting operation to insert an inner sheet between the two sheets separated from each other by the sheet separating operation. The sheet lamination device is configured to perform a sheet laminating operation on the two-ply sheet after the sheet separating operation and the sheet inserting operation performed by the sheet separation device. The circuitry is configured to cause the sheet lamination device to perform the sheet laminating operation on the two-ply sheet while causing the sheet separation device to perform the sheet separating operation on another two-ply sheet subsequent to the two-ply sheet or the sheet separating operation and the sheet inserting operation on said another two-ply sheet.

Further, embodiments of the present disclosure described herein provide an image forming apparatus including a housing that includes an image forming apparatus that is configured to form an image on a sheet, and the above-described sheet laminator.

Further, embodiments of the present disclosure described herein provide an image forming system including an image forming apparatus that is configured to form an image on a sheet, and the above-described sheet laminator that is detachably attached to the image forming apparatus.

BRIEF DESCRIPTION OF THE SEVERAL VIEWS OF THE DRAWINGS

Exemplary embodiments of this disclosure will be described in detail based on the following figures, wherein.

Figure 1:
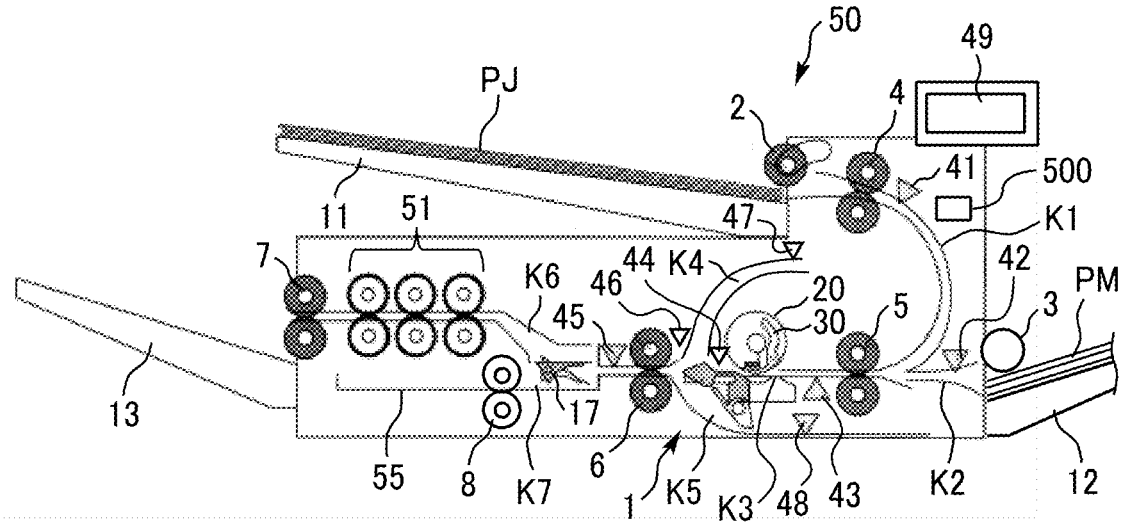
FIG. 1 is a schematic view illustrating the overall configuration of a sheet laminator according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Next, a description is given of a configuration and functions of a sheet laminator, an image forming apparatus, and an image forming system, according to an embodiment of the present disclosure, with reference to drawings. Note that identical parts or equivalents are given identical reference numerals and redundant descriptions are summarized or omitted accordingly.

First, a description is given of the overall configuration and operations of a sheet laminator 50, with reference to FIG. 1.

The sheet laminator 50 includes a sheet separation device 1, a sheet lamination device 51, a first ejection tray 13, a second ejection tray 55 that functions as a retract portion.

The sheet separation device 1 includes a first feed tray 11, a second feed tray 12, a first feed roller 2, a second feed roller 3, a first conveyance roller pair 4, a second ejection roller pair 8, a third conveyance roller pair 6, a first sensor 41, a second sensor 42, a third sensor 43, a fourth sensor 44, a fifth sensor 45, a sixth sensor 46, a seventh sensor 47, an eighth sensor 48, a winding roller 20, a moving mechanism 30, and separation claws 16 (see FIGS. 6A to 6C and FIGS. 12A to 12E). Each of the separation claws 16 functions as a separator. The sheet separation device 1 further includes a controller 500 that controls sheet conveyance of the sheet (i.e., the two-ply sheet PJ and the inner sheet PM) by performing, e.g., a sheet separating operation, a sheet laminating operation, and a sheet inserting operation. The controller 500 is connected to various drivers driving various parts and units, for example, the above-described parts and units included in the sheet separation device 1.

The sheet separation device 1 performs a sheet separating operation and a sheet inserting operation. To be more specific, the sheet separation device 1 performs the sheet separating operation to separate the non-bonding portion of a two-ply sheet PJ in which two sheets, which are a first sheet P1 and a second sheet P2, are overlapped and bonded together at one end of the two-ply sheet PJ as a bonding portion A of the two-ply sheet PJ (see FIGS. 12A to 12E and other drawings). The sheet separation device 1 then performs the sheet inserting operation to insert an inner sheet PM between the first sheet P1 and the second sheet P2 separated from each other by the sheet separating operation.

In particular, in the present embodiment, the two-ply sheet PJ is made of the first sheet P1 and the second sheet P2 overlapped and bonded together at one side of four sides as the bonding portion A. That is, in the two-ply sheet PJ including the first sheet P1 and the second sheet P2, one side (the bonding portion A) of the first sheet P1 and one side (the bonding portion A) of the second sheet P2 are connected by, e.g., thermal welding, and the other side of the first sheet P1 and the other side of the second sheet P2 are not connected. As the first sheet P1 and the second sheet P2 constructing the two-ply sheet PJ, a transparent film sheet (that is, a laminated sheet) may be employed.

The sheet separation device 1 separates the first sheet P1 and the second sheet P2 constructing the two-ply sheet PJ, in other words, separates the other side of the two sheets that is opposite the bonding portion A that maintains bonding of the first sheet P1 and the second sheet P2. Subsequently, the sheet separation device 1 inserts an inner sheet PM between the separated two sheets, which are the first sheet P1 and the second sheet P2 constructing the two-ply sheet PJ. The inner sheet PM is a sheet including at least one plain sheet or a photograph.

The sheet lamination device 51 performs the sheet laminating operation on the two-ply sheet PJ after the sheet separating operation and the sheet inserting operation are performed on the two-ply sheet PJ by the sheet separation device 1.

Specifically, the sheet lamination device 51 performs the sheet laminating operation on the two-ply sheet PJ in a state in which the inner sheet PM is inserted between two sheets, which are the first sheet P1 and the second sheet P2 constructing the two-ply sheet PJ, separated from each other by the sheet separation device 1. In other words, the sheet lamination device 51 applies heat and pressure on the non-bonding portion of the two sheets (i.e., the first sheet P1 and the second sheet P2 constructing the two-ply sheet PJ) to bond the two sheets together in a state in which the inner sheet PM. The sheet lamination device 51 is disposed downstream from the sheet separation device 1 in the sheet conveyance direction, that is, the downstream side in the forward direction and the left side in FIG. 1. The sheet lamination device 51 includes a plurality of heat-pressure roller pairs 51*a*, 51*b*, and 51*c* aligned along the sheet conveyance direction (see FIGS. 9A to 10C). Each of the plurality of heat-pressure roller pairs 51*a*, 51*b*, and 51*c* applies heat and pressure to the two-ply sheet PJ while conveying the two-ply sheet PJ in the forward direction in a state in which the inner sheet PM is inserted in the two-ply sheet PJ. Further, a fourth sheet conveyance passage K6 that functions as a sheet conveyance passage is disposed between the third conveyance roller pair 6 and the sheet lamination device 51.

The first ejection tray 13 functions as an ejection tray on which the two-ply sheet PJ (and the inner sheet PM) is stacked when the two-ply sheet PJ is ejected after the sheet laminator 50 has performed the sheet laminating operation on the two-ply sheet PJ.

The second ejection tray 55 functions as an ejection tray on which a sheet on which the sheet laminator 50 does not perform the sheet laminating operation is stacked. Note that the second ejection tray 55 also functions as a retract portion onto which a subsequent two-ply sheet is temporarily purged (ejected), when the sheet laminator 50 performs the sheet laminating operation consecutively. The detailed description of the second ejection tray 55 functioning as a retract portion is given below, with reference to FIGS. 9A to 10C.

The sheet laminator 50 further includes a plurality of sheet conveyance passages such as a first sheet conveyance passage K1, a second sheet conveyance passage K2, a third sheet conveyance passage K3, a first branched sheet conveyance passage K4, a second branched sheet conveyance passage K5, a fourth sheet conveyance passage K6, and a retract sheet conveyance passage K7. Each of the first sheet conveyance passage K1, the second sheet conveyance passage K2, the third sheet conveyance passage K3, the first branched sheet conveyance passage K4, the second branched sheet conveyance passage K5, the fourth sheet conveyance passage K6, and the retract sheet conveyance passage K7 extends from the sheet separation device 1 to the sheet lamination device 51 and includes two conveyance guides (guide plates) facing each other to guide and convey the sheet such as the two-ply sheet PJ and the inner sheet PM.

In particular, in the present embodiment, the first branched sheet conveyance passage K4 and the second branched sheet conveyance passage K5 branch off in different directions from the third sheet conveyance passage K3. The first branched sheet conveyance passage K4 and the second branched sheet conveyance passage K5 are disposed opposite across the third sheet conveyance passage K3, between the winding roller 20 and the third sheet conveyance passage K3.

Further, the fourth sheet conveyance passage K6 is a sheet conveyance passage extending from (the third conveyance roller pair 6 of) the sheet separation device 1 to the sheet lamination device 51. Further, the retract sheet conveyance passage K7 is a sheet conveyance passage extending from (the sheet lamination device 51 of) the sheet separation device 1 to the second ejection tray 55 (retract portion). To be more specific, the fourth sheet conveyance passage K6 and the retreat sheet conveyance passage K7 branch off in different directions from the downstream side (that is, the left side in FIG. 1) of the third conveyance roller pair 6.

As illustrated in FIG. 1, for example, the two-ply sheet PJ is loaded on the first feed tray 11. The first feed roller 2 feeds the uppermost two-ply sheet PJ on the first feed tray 11, to the first conveyance roller pair 4, and the first conveyance roller pair 4 conveys the two-ply sheet PJ along the first sheet conveyance passage K1.

Each of the first feed tray 11 and the first feed roller 2 functions as a first sheet feeder to feed the two-ply sheet PJ. The first sheet feeder is controlled by the controller 500. To be more specific, the controller 500 drives and rotates the first feed roller 2 to feed the two-ply sheet PJ from the first feed tray 11.

Further, the inner sheet PM is loaded on the second feed tray 12. Then, the second feed roller 3 feeds the uppermost two-ply sheet PJ on the second feed tray 12.

As described above, each of the second feed tray 12 and the second feed roller 3 functions as a second sheet feeder to feed the inner sheet PM that is a sheet to be inserted between the two sheets, which are the first sheet P1 and the second sheet P2 of the two-ply sheet PJ with the non-bonding portion being separated. Then, the controller causes the second feed roller 3 to drive and rotate as a second sheet feeder, so as to feed the inner sheet PM from the second feed tray 12 as a second sheet feeder.

Then, in the sheet laminator 50 according to the present embodiment, the controller 500 causes the second feed roller 3 (second sheet feeder) to start feeding the inner sheet PM from the second feed tray 12 (second sheet feeder) after the first feed roller 2 (first sheet feeder) has fed the two-ply sheet PJ from the first feed tray 11 (first sheet feeder) and before the operation to separate the non-bonding portion of the two-ply sheet PJ is completed.

That is, in the present embodiment, the feeding of the two-ply sheet PJ and the feeding of the inner sheet PM are not performed separately (operated by a user via the operation display panel 49) but are performed in a single operation. To be more specific, as a user presses the button on the operation display panel 49 once to start the operation, the sheet separating operation in which the two-ply sheet PJ is fed and separated, the sheet inserting operation in which the inner sheet PM is inserted into the two-ply sheet PJ between the first sheet P1 and the second sheet P2 separated from each other, and the sheet laminating operation are collectively performed automatically based on the single instruction.

The operation to start feeding the inner sheet PM from the second feed tray 12 is performed not after completion of the sheet separating operation of the two-ply sheet PJ but performed before completion of the sheet separating operation of the two-ply sheet PJ. Therefore, the time required for a series of steps from when the two-ply sheet PJ is fed from the first feed tray 11 to when the inner sheet PM is completely inserted in the two-ply sheet PJ is reduced efficiently, and therefore the productivity of the sheet separation device 1 is enhanced. That is, the time required for the operation from the start to the end performed by the sheet laminator 50 is reduced.

Each of the first conveyance roller pair 4, the second conveyance roller pair 5, the third conveyance roller pair 6, a first ejection roller pair 7, and a second ejection roller pair 8 includes a drive roller and a driven roller and conveys the sheet nipped by the respective nip regions. The third sheet conveyance passage K3 includes the second conveyance roller pair 5, the winding roller 20, and the third conveyance roller pair 6 in this order from upstream to downstream in the sheet conveyance direction. In particular, the winding roller 20, the third conveyance roller pair 6, and the second ejection roller pair 8 are configured to be rotatable in a forward direction or in a reverse direction. The third conveyance roller pair 6 and the second ejection roller pair 8 convey the sheet in the forward direction that is the left direction in FIG. 1 and in the reverse direction that is the right direction in FIG. 1. The third conveyance roller pair 6 also functions as a sheet conveying roller pair that conveys the sheet to the sheet lamination device 51 or to the second ejection tray 55. The first ejection roller pair 7 functions as a sheet conveying roller pair that conveys and ejects the two-ply sheet PJ (and the inner sheet PM) after the sheet laminating operation, toward the first ejection tray 13.

Note that a switching claw 17 is disposed downstream from the third conveyance roller pair 6 in the forward direction (sheet conveyance direction to the left in FIG. 1). The switching claw 17 that functions as a switcher switches the direction of conveyance of the sheet P, for example, by conveying the sheet P toward the sheet lamination device 51 or toward the second ejection tray 55.

That is, the switching claw 17 functions as a switcher that switches a first state and a second state. The first state is a state in which the fourth sheet conveyance passage K6 is open and the retract sheet conveyance passage K7 is closed, which is the state illustrated in FIG. 9A, for example. The second state is a state in which the fourth sheet conveyance passage K6 is closed and the retract sheet conveyance passage K7 is open, which is the state illustrated in FIG. 9C, for example.

The switching claw 17 is controlled according to the mode selected by a user (in particular, when the sheet laminating operation is consecutively performed on the plurality of two-ply sheets PJ), so as to switch the direction of conveyance (ejection) of the sheet P.

A detailed description is given below of the operations of the switching claw 17 functioning as a switcher, with reference to FIGS. 9A to 9D and FIGS. 10A to 10C, for example.

Referring to FIG. 1, each of the first sensor 41, the second sensor 42, the third sensor 43, the fourth sensor 44, and the fifth sensor 45, the seventh sensor 47, and the eighth sensor 48 functions as a sheet detector employing a reflective photosensor that optically detects whether the sheet is present at the position of each sensor. The first sensor 41 is disposed near a portion downstream from the first conveyance roller pair 4 in the sheet conveyance direction. The second sensor 42 is disposed near a portion downstream from the second feed roller 3 in the sheet conveyance direction. The third sensor 43 is disposed near a portion downstream from the second conveyance roller pair 5 in the sheet conveyance direction. The fourth sensor 44 is disposed near a portion downstream from the winding roller 20 (at the left side of the winding roller 20 in FIG. 1) and upstream from the third conveyance roller pair 6 (at the right side of the third conveyance roller pair 6 in FIG. 1) in the sheet conveyance direction. The fifth sensor 45 is disposed downstream from the fourth sheet conveyance passage K6 from the sheet separation device 1 to the sheet lamination device 51 (at the left side of the third conveyance roller pair 6 in FIG. 1) in the sheet conveyance direction. Further, the seventh sensor 47 is disposed on the first branched sheet conveyance passage K4. The eighth sensor 48 is disposed on the second branched sheet conveyance passage K5.

Note that the sixth sensor 46 functions as an abnormality detector that detects an abnormal state while the sheet separating operation is performed. The detailed description of the sixth sensor 46 is given below.

A description is given of the winding roller 20, with reference to FIGS. 2A, 2B, 3A, 3B, 5B to 5D, and 6A.

Figure 5A:
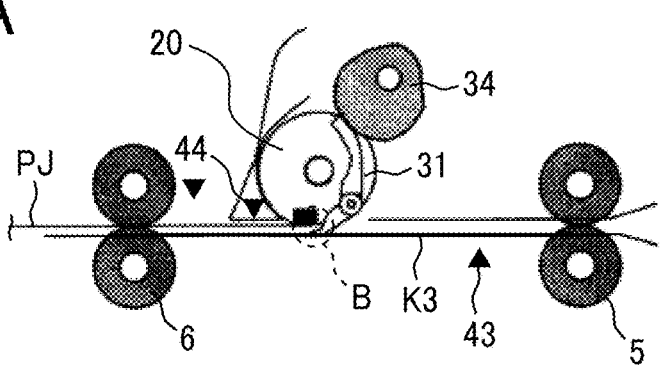
FIGS. 5A to 5D are schematic views, each illustrating the sheet separating operation performed in the sheet laminator, subsequent from the sheet separating operation of FIGS. 4A to 4D.
Figure 5A:
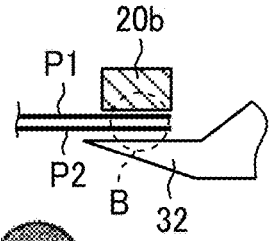
Figure 5B:
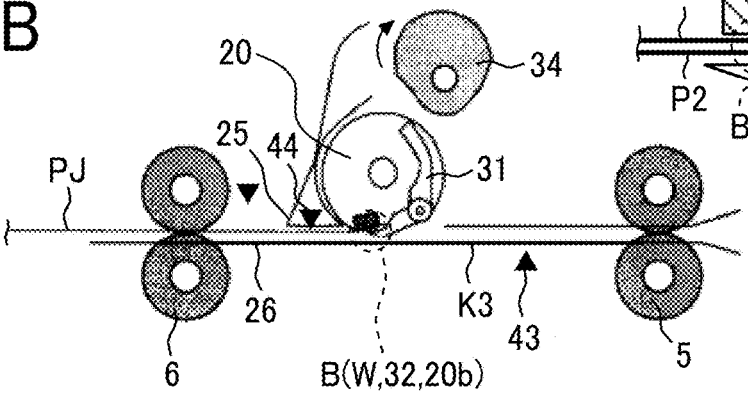
Figure 5B:
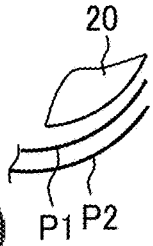

The winding roller 20 is a roller that winds the two-ply sheet PJ, with a gripper 32 that is one example of a gripper (handle) grips a gripped portion B of the two-ply sheet PJ at a winding start position W (see FIG. 5B). The gripped portion B is an end of the two-ply sheet PJ that is opposite an end at which the bonding portion A is formed, which is referred to as the other end of the two-ply sheet PJ. While the gripper 32 grips the gripped portion B of the two-ply sheet PJ, the winding roller 20 rotates in a predetermined rotation direction (that is, the counterclockwise direction in FIGS. 5A to 5D) to wrap the two-ply sheet PJ around the winding roller 20. The winding roller 20 is rotatable about a rotary shaft 20*a* in the forward direction and in the reverse direction. The controller 500 controls a drive motor that drives the winding roller 20.

To be more specific, the two-ply sheet PJ is fed from the first feed tray 11, passes through the first sheet conveyance passage K1, and is conveyed by the second conveyance roller pair 5 in the forward direction along the third sheet conveyance passage K3. The two-ply sheet PJ passes through the winding start position W of the winding roller 20 once and is conveyed to a position of the third conveyance roller pair 6 that is a position at which the trailing end of the two-ply sheet PJ passes through the fourth sensor 44 but does not pass through the third conveyance roller pair 6, that is, the position before the third conveyance roller pair 6. Thereafter, the third conveyance roller pair 6 rotates in the reverse direction to convey the two-ply sheet PJ in the reverse direction to the position of the winding roller 20 that is the winding start position W, and the gripper 32 grips the other end (leading end) of the two-ply sheet PJ. The two-ply sheet PJ is further conveyed in a state in which the other end (leading end) of the two-ply sheet PJ is gripped by the gripper 32, and the winding roller 20 rotates in the counterclockwise direction in FIG. 1 to wind the two-ply sheet PJ around the winding roller 20.

Figure 5C:
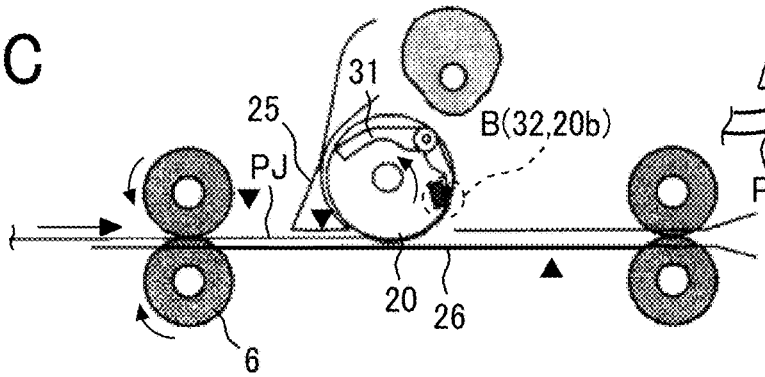
Figure 5D:
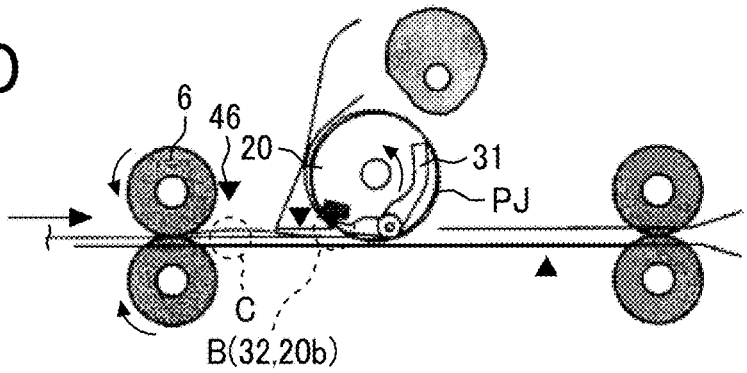
Figure 6A:
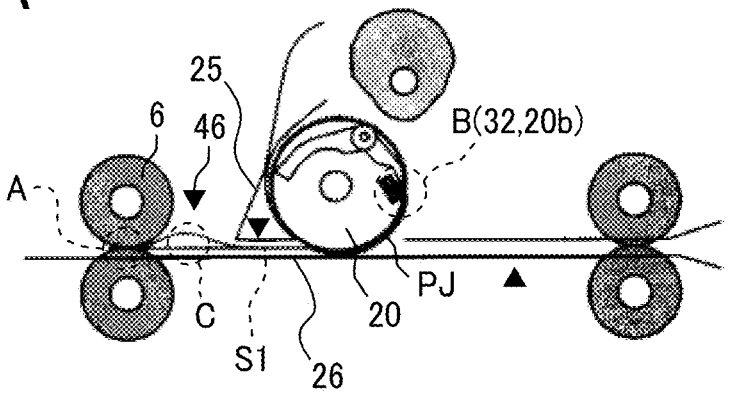
FIGS. 6A to 6C are schematic views, each illustrating the sheet separating operation performed in the sheet laminator, subsequent from the sheet separating operation of each of FIGS. 5A to 5D.

With reference to FIG. 5C', when the two-ply sheet PJ is wound around the winding roller 20, the length of a sheet wound around the winding roller 20 is proportional to the diameter of the winding roller 20. Therefore, since a first sheet P1 is on the inner side to the center of the winding roller 20, that is, closer to the inner circumferential surface of the winding roller 20, than a second sheet P2 on the outer side to the center of the winding roller 20, that is, closer to the outer circumferential surface of the winding roller 20, the length of the first sheet P1 wound around the winding roller 20 is shorter than the length of the second sheet P2 wound around the winding roller 20. As a result, misalignment occurs in a part of the two-ply sheet PJ in which the sheet P1 is in close contact with the sheet P2 (in other words, the part in which the sheet P1 sticks to the sheet P2) other than the bonding portion A and the gripped portion B. The misalignment causes the first sheet P1 to slack and bend toward the second sheet P2, forming a gap C between the two sheets, which are the first sheet P1 and the second sheet P2, in the vicinity of the bonding portion A of the two-ply sheet PJ, as illustrated in FIGS. 5D and 6A. In other words, when the first sheet P1 that is placed on the second sheet P2 is warped upward, the gap C is formed between the first sheet P1 and the second sheet P2 at one end of the two-ply sheet PJ, that is, the upstream side in the sheet conveyance direction when the two-ply sheet PJ is conveyed in the right direction in FIG. 1. As described above, the two sheets P1 and P2 that are in close contact with each other without any gap are separated from each other.

Particularly in the present embodiment, in order to significantly form the gap C as described above, that is, in order to increase the difference between the length of the first sheet P1 wound around the winding roller 20 and the length of the second sheet P2 wound around the winding roller 20, the two-ply sheet PJ is wound around the winding roller 20 at least one round.

As described above, in the present embodiment, by providing the winding roller 20 to wind the two-ply sheet PJ around the rotary shaft 20*a*, the two-ply sheet PJ is separatable without increasing the size and cost of the sheet laminator 50.

As illustrated in FIG. 5B', the gripper 32 in the present embodiment is configured to grip the gripped portion B of the two-ply sheet PJ without contacting the end surface of the other end of the gripped portion B of the two-ply sheet PJ.

Specifically, the gripper 32 is configured to sandwich and grip the gripped portion B of the two-ply sheet PJ between the gripper 32 and a receiving portion 20*b* of the winding roller 20 without causing any member to abut and restrict the end surface of the other end of the two-ply sheet PJ, in other words, without causing any member to hit or contact the end surface of the two-ply sheet PJ. The receiving portion 20*b* of the winding roller 20 is a part of the outer circumferential portion of the winding roller 20 and is arranged to be exposed outwardly and facing the gripper 32.

To be more specific, the two-ply sheet PJ is not nipped and gripped by the gripper 32 and the receiving portion 20*b* of the winding roller 20 in a state in which a specific member such as the gripper 32 contacts the end surface of the other end (that is the leading end face). The two-ply sheet PJ is nipped and gripped by the gripper 32 and the receiving portion 20*b* while the end surface of the other end (leading end face) does not contact any member. In this state, the gripper is located close to the second sheet P2 on the outer side to the center of the winding roller 20 and the receiving portion 20*b* is located close to the first sheet P1 on the inner side to the center of the winding roller 20.

Therefore, when compared with a configuration in which the leading end face of the two-ply sheet PJ contacts a member, the above-described structure according to the present embodiment reduces damage on the two-ply sheet PJ (particularly, the leading end). In particular, once the leading end face of the two-ply sheet PJ is damaged, it is difficult to perform the sheet laminating operation on the damaged leading end face. Therefore, the configuration of the present disclosure is useful.

Note that, in the present embodiment, the bonding portion A of the two-ply sheet PJ wound around the winding roller 20 is the one end of the two-ply sheet PJ. The one end is opposite to the other end functioning as the gripped portion B.

In the present embodiment, at least one of the gripper 32 (handle) and the receiving portion 20*b* is made of elastic material such as rubber.

According to this configuration, when compared with a sheet separation device having a configuration in which the gripper 32 and the receiving portion 20*b* have rigid bodies made of metal or resin, the above-described sheet separation device 1 according to the present embodiment enhances the gripping force to grip the two-ply sheet PJ and prevents the surfaces of the two-ply sheet PJ from being damaged. In particular, the sheet separation device 1 including the gripper 32 and the receiving portion 20*b* made of the elastic material easily exhibits the above-described effect.

As illustrated in FIGS. 2A, 2B, 3A, and 3B, the moving mechanism 30 moves the gripper 32 between a gripping position (a position illustrated in FIGS. 2A and 3A) at which the gripper 32 can grip the two-ply sheet PJ and a releasing position (a position illustrated in FIGS. 2B and 3B) at which the gripper 32 is released from the gripping position.

To be more specific, the moving mechanism 30 includes an arm 31, a compression spring 33, a cam 34, and a motor. The compression spring 33 functions as a biasing member. The motor drives to rotate the cam 34 in the forward direction or the reverse direction.

The arm 31 holds the gripper 32. The arm 31 and the gripper 32 are held together by the winding roller 20 to be rotatable together about a support shaft 31*a*. In the present embodiment, the gripper 32 is connected to the tip of the arm 31, and the gripper 32 and the arm 31 are made (held) as a single unit. Alternatively, the gripper 32 and the arm 31 may be made as separate members, and the gripper 32 may be mounted on the arm 31, that is, may be held by the arm 31. In any case, the arm 31 holding the gripper 32 rotates about the rotary shaft 20*a* together with the winding roller 20.

Figure 2A:
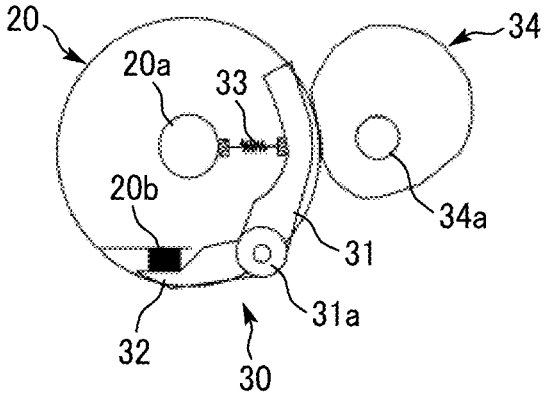
FIG. 2A is a side view illustrating a gripper that has moved to a gripping position in the sheet laminator illustrated in FIG. 1.
Figure 2B:
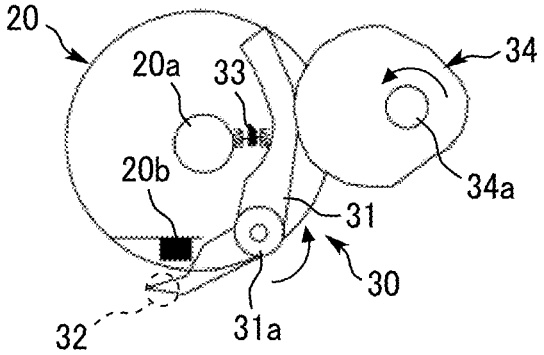
FIG. 2B is a side view illustrating the gripper that has moved to a releasing position in the sheet laminator illustrated in FIG. 1.

The compression spring 33 functions as a biasing member that biases the arm 31 so that the gripper 32 moves from the releasing position illustrated in FIG. 2B to the gripping position illustrated in FIG. 2A. To be more specific, one end of the compression spring 33 is connected to a fixed position near the rotary shaft 20*a*, and the other end of the compression spring 33 is connected to one end of the arm 31 that is an end opposite to the other end of the arm 31 connected to the gripper 32 with respect to the support shaft 31*a*.

The cam 34 pushes the arm 31 against the biasing force of the compression spring 33 that functions as the biasing member, so that the gripper 32 moves from the gripping position illustrated in FIG. 2A to the releasing position illustrated in FIG. 2B. The motor controlled by the controller 500 drives the cam 34 to rotate in the forward direction or the reverse direction at a desired rotation angle. The cam 34 is held by the apparatus housing so as to be rotatable about a cam shaft 34*a* separately from the winding roller 20.

In the moving mechanism 30 configured as described above, as illustrated in FIGS. 2A and 3A, in a state in which the cam 34 is not in contact with the arm 31, the arm 31 is biased by the compression spring 33 to press the gripper 32 against the receiving portion 20*b*. This state is referred to as a closed state. In the closed state, the gripper 32 and the receiving portion 20*b* grip the two-ply sheet PJ.

Figure 3A:
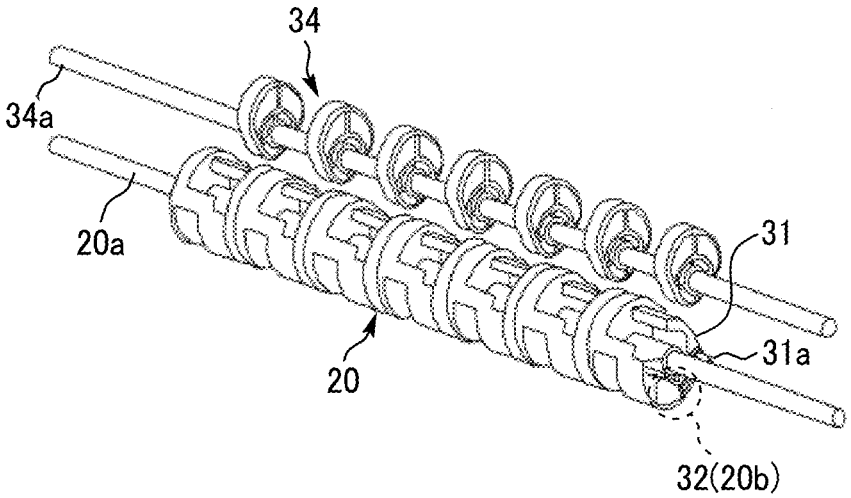
FIG. 3A is a perspective view illustrating the gripper that has moved to the gripping position in the sheet laminator illustrated in FIG. 1.
Figure 3B:
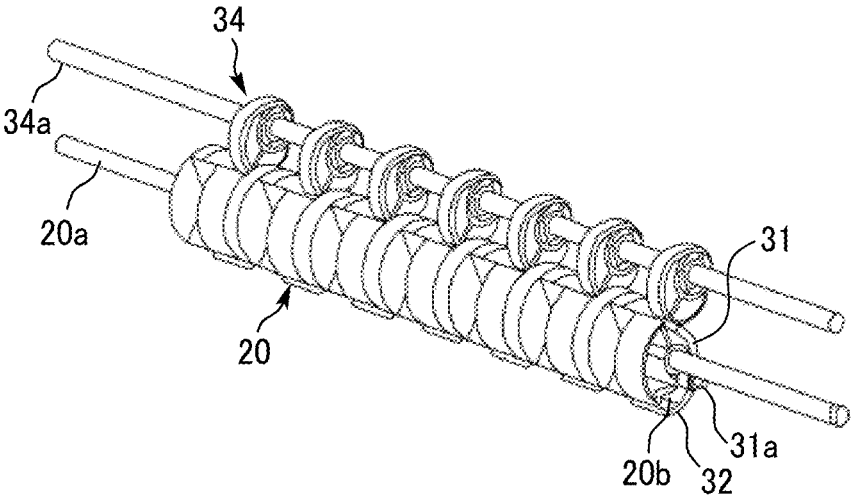
FIG. 3B is a perspective view illustrating the gripper that has moved to the releasing position in the sheet laminator illustrated in FIG. 1.

By contrast, as illustrated in FIGS. 2B and 3B, in a state in which the cam 34 is contacts and presses the arm 31, the arm 31 rotates in the counterclockwise direction in FIG. 2B about the support shaft 31*a* against the biasing force of the compression spring 33, so that the gripper 32 separates from the receiving portion 20*b*. This state is referred to as an open state. In the open state, the two-ply sheet PJ is not gripped, which is referred to as a grip release state.

Note that, in the present embodiment, as illustrated in FIGS. 3A and 3B, the winding roller 20 includes a plurality of roller portions (i.e., seven roller portions in the present embodiment) separated in the axial direction of the winding roller 20. Similarly, the cam 34 includes a plurality of cam portions separated in the axial direction of the cam 34 so that the divided positions of the plurality of cam portions of the cam 34 respectively meet and face the plurality of roller portions of the winding roller 20.

Setting portions separated in the axial direction to grip the two-ply sheet PJ as described above, that is, not setting the entire area of the winding roller 20 and the cam 34 in the axial direction to grip the two-ply sheet PJ share load to grip the two-ply sheet PJ. The above-described configuration is useful when a gripping force required to grip the two-play sheet PJ increases.

Figure 4A:
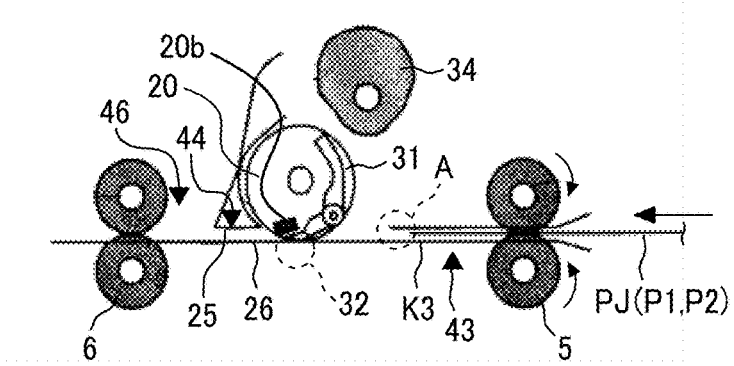
FIGS. 4A to 4D are schematic views, each illustrating the sheet separating operation performed in the sheet laminator illustrated in FIG. 1.
Figure 4B:
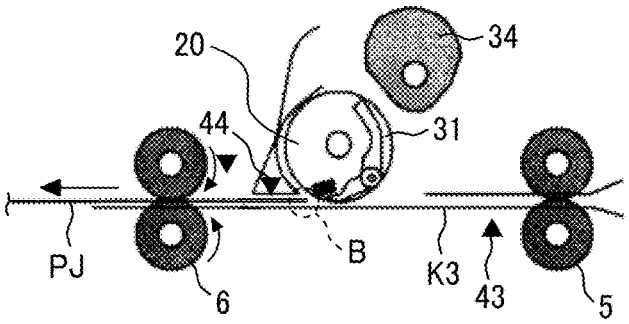
Figure 4C:
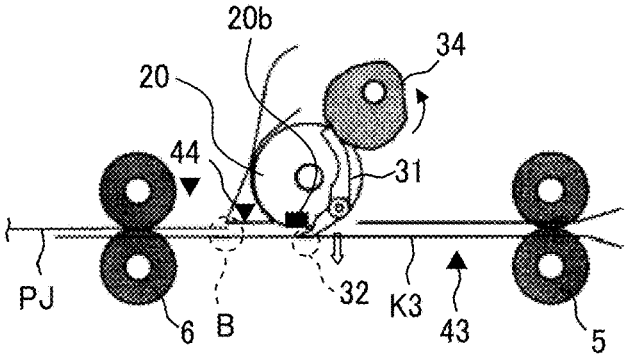
Figure 4D:
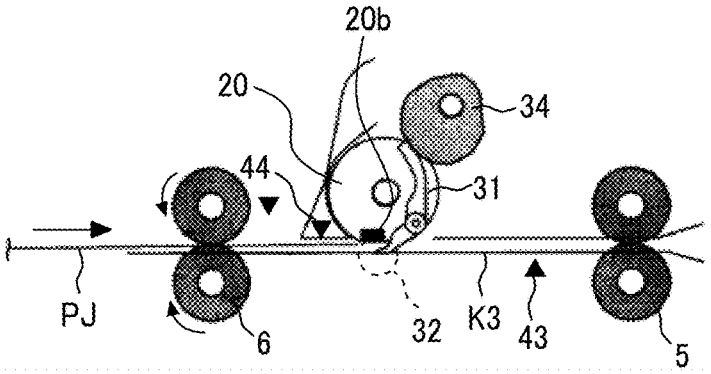

Here, a description is given of the fourth sensor 44 in the sheet laminator 50 according to the present embodiment, with reference to FIGS. 1, 4D, and 5A.

The fourth sensor 44 functions as a sheet detector to detect the two-ply sheet PJ conveyed between the winding roller 20 and the third conveyance roller pair 6. The fourth sensor 44 detects the leading end of the two-ply sheet PJ conveyed to the winding roller 20 in the sheet conveyance direction by the third conveyance roller pair 6. Based on the detection results detected by the fourth sensor 44, the controller 500 controls the moving mechanism 30.

To be more specific, the fourth sensor 44 is disposed in the sheet conveyance passage between the winding roller 20 and the third conveyance roller pair 6. As illustrated in FIGS. 4D and 5A, when the third conveyance roller pair 6 conveys the two-ply sheet PJ in the reverse direction toward the position of the winding roller 20 with the gripped portion B of the two-ply sheet PJ being the leading end, the fourth sensor 44 detects the leading end (that is, the tip of one end of the gripped portion B) of the two-ply sheet PJ conveyed in the reverse direction. In response to the detection timing at which the fourth sensor 44 detects the leading end (in the reverse direction) of one end of the gripped portion B, the controller 500 adjusts and controls a timing to stop the two-ply sheet PJ at the gripping position and a timing at which the gripper 32 grips the gripped portion B. Specifically, after a predetermined time has passed since the fourth sensor 44 detected the front end of the two-ply sheet PJ, the third conveyance roller pair 6 stops the reverse direction conveyance of the two-ply sheet PJ, and the cam 34 rotates to pivot the arm 31 of the moving mechanism 30 so that the gripper 32 moves from the releasing position illustrated in FIG. 2B to the gripping position illustrated in FIG. 2A.

The above-described control accurately performs an operation in which the end surface of the two-ply sheet PJ is nipped by the gripper 32 and the receiving portion 20*b* without contacting (abutting) the end surface of the two-ply sheet PJ on any member.

As described above, the third conveyance roller pair 6 is a sheet conveying roller pair that conveys the two-ply sheet PJ with the other end (i.e., the gripped portion B) as a leading end, toward the winding start position W of the winding roller 20 in the third sheet conveyance passage K3 (sheet conveyance passage) between the third conveyance roller pair 6 and the winding roller 20.

Now, a description is given of the separation claws 16 each functioning as a separator, with reference to FIGS. 6A to 6C, 11, 12A to 12E, and 15.

Figure 12A:
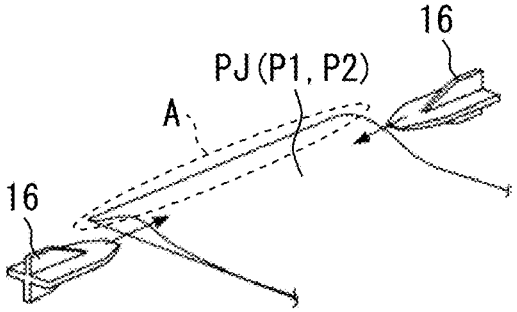
FIGS. 12A to 12E are perspective views, each illustrating the operation of the separation claws.

Each of the separation claws 16 is a claw-shaped member that moves from the standby position illustrated in FIG. 12A and is inserted into the gap C formed between the first sheet P1 and the second sheet P2 of the two-ply sheet PJ at a predetermined position of the two-ply sheet PJ.

To be more specific, the separation claws 16 are inserted into the gap C formed between the first sheet P1 and the second sheet P2 at a position between the winding roller 20 and the third conveyance roller pair 6 from the standby positions outside both ends of the two-ply sheet PJ in the width direction of the two-ply sheet PJ in a state in which the other end (that is the gripped portion B) is wound by the winding roller 20 and the one end (that is the bonding portion A) is nipped by the third conveyance roller pair 6.

Figure 6B:
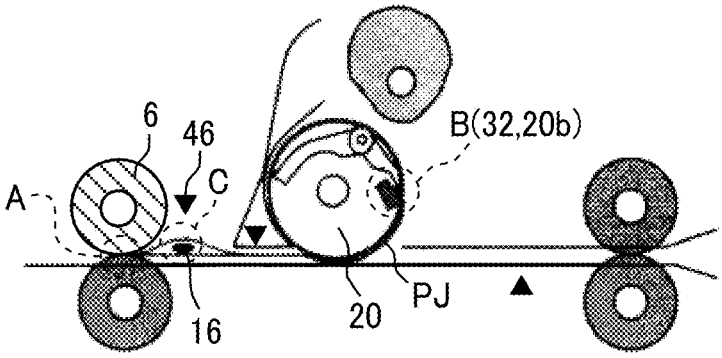
Figure 6C:
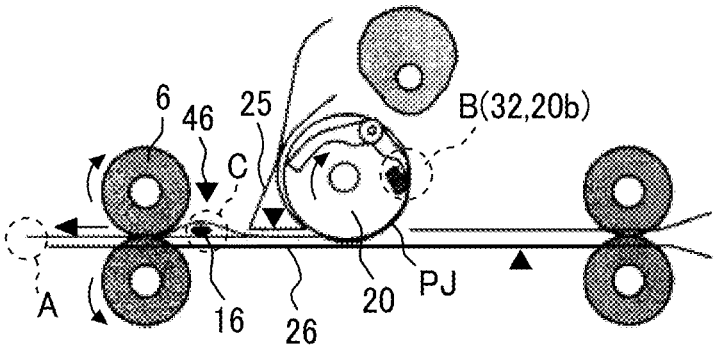
Figure 11:
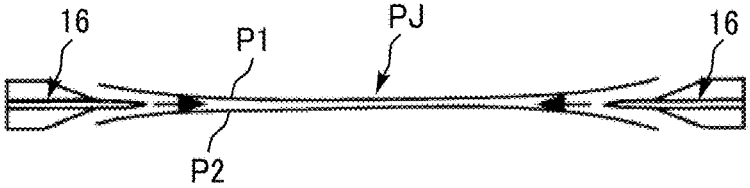
FIG. 11 is a schematic view illustrating separation claws inserted into a two-ply sheet in a width direction of the two-ply sheet.
Figure 15:
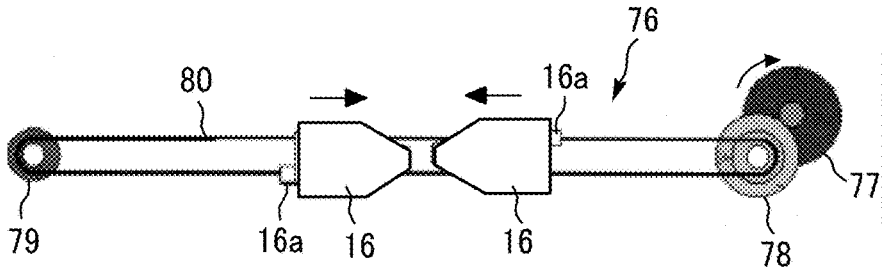
FIG. 15 is a schematic view illustrating the configuration of a moving mechanism to move the separation claws.

More specifically, in the present embodiment, the separation claws 16 are a pair of separation claws that functions as a pair of separators disposed at both sides of the two-ply sheet PJ in the width direction that is the direction perpendicular to a plane on which FIGS. 6A to 6C are illustrated and the horizontal direction in FIGS. 11 and 15. As illustrated in FIGS. 12A to 12E, the vertical length of each of the separation claws 16 in the vertical direction (thickness direction) of the two-ply sheet PJ gradually increases from the tip of each of the separation claws 16 near the center in the width direction of the two-ply sheet PJ, to the rear end of the separation claw 16 near the outsides in the width direction of the two-ply sheet PJ. Further, the separation claws 16 are movable in the width direction of the two-ply sheet PJ by a driving device 76 (see FIG. 15) controlled by the controller 500.

Figure 12B:
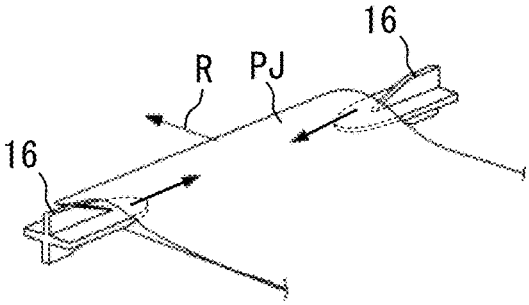

The separation claws 16 configured as described above ordinarily stand by at respective standby positions at which the separation claws 16 do not interfere with conveyance of the sheet such as the two-ply sheet PJ in the third sheet conveyance passage K3. As illustrated in FIG. 12A, the standby positions of the separation claws 16 are outside of the two-ply sheet PJ (including the first sheet P1 and the second sheet P2) in the width direction of the two-ply sheet PJ. Subsequently, as illustrated in FIGS. 11 and 12B, the separation claws 16 enter the gap C in the two-ply sheet PJ when separating the two-ply sheet PJ (including the first sheet P1 and the second sheet P2). As a result, the separation claws 16 secure the gap C to be relatively large.

As illustrated in FIG. 15, the driving device 76 that moves the pair of separation claws 16 in the width direction includes a motor 77, a gear pulley 78, a pulley 79, and a timing belt 80. The gear pulley 78 has a step-like ring shape including a gear and a pulley. The gear meshes with a motor gear mounted on a motor shaft of the motor 77. The pulley stretches and supports the timing belt 80 together with the pulley 79. One separation claw 16 of the pair of separation claws 16 includes a fixed portion 16*a* that is fixed to a part of the belt surface of the timing belt 80 that is the upper side of the belt surface in FIG. 15. The other separation claw 16 includes a fixed portion 16*a* that is fixed to a part of the other belt surface of the timing belt 80 that is the lower side of the belt surface in FIG. 15.

In the driving device 76 as configured described above, the motor 77 drives to rotate the motor shaft in a direction indicated by arrow in FIG. 15 (i.e. clockwise direction), the gear pulley 78 rotates counterclockwise, the timing belt 80 rotates in the counterclockwise direction, and the pair of separation claws 16 moves from the outside in the width direction of the two-ply sheet PJ to the center in the width direction of the two-ply sheet PJ (that is, the pair of separation claws 16 approaches each other). In contrast, when the motor 77 drives to rotate the motor shaft in the direction opposite to the arrow direction in FIG. 15, the pair of separation claws 16 moves from the center in the width direction of the two-ply sheet PJ toward the outside in the width direction of the two-ply sheet PJ (that is, the pair of the separation claws 16 moves in a direction away from each other).

In a state in which the separation claws 16 are inserted into the gap C in the two-ply sheet PJ, the separation claws 16 relatively move from the one end of the two-ply sheet PJ near the bonding portion A to the other end of the two-ply sheet PJ near the gripped portion B. Then, the separation claws 16 move in the width direction between the first sheet P1 and the second sheet P2 at the other end of the two-ply sheet PJ.

Specifically, the controller 500 controls the driving device 76 (see FIG. 15) to move the pair of separation claws 16 as follows. As illustrated in FIGS. 11B and 11C, the pair of separation claws 16 is inserted into both ends of the gap C in the two-ply sheet PJ in the width direction and relatively moves to the other end of the two-ply sheet PJ that is the gripped portion B. After the pair of separation claws 16 has relatively moved to the other end of the two-ply sheet PJ, as illustrated in FIG. 12D, the pair of separation claws 16 on the other end of the two-ply sheet PJ moves in the width direction from both ends of the two-ply sheet PJ to the center of the two-ply sheet PJ between the first sheet P1 and the second sheet P2. In order to cause the pair of separation claws 16 to move as described above, the driving device 76 is configured so that the pair of separation claws 16 moves from the standby positions to the positions at which the separation claws 16 come close to each other.

The above-described mechanism, which includes the winding roller 20 to wind the two-ply sheet PJ and the separation claws 16 to be inserted into the two-ply sheet PJ so as to separate the two-ply sheet PJ, reduces the size of the sheet separation device 1, when compared with a mechanism using a large-scale device such as a vacuum device to separate the two-ply sheet PJ. That is, without increasing the size of the sheet laminator 50, the above-described mechanism reliably separates the first sheet P1 and the second sheet P2 constructing the two-ply sheet PJ.

In particular, since the separation claws 16 in the present embodiment move over substantially the entire area in the width direction of the two-ply sheet PJ on the other end of the two-ply sheet PJ (that is the trailing end of the two-ply sheet PJ), the separation claws 16 sufficiently separate (in other words, peel) the other ends of the first sheet P1 and the second sheet P2 constructing the two-ply sheet PJ that is opposite the bonding portion A. Therefore, it is less likely that the above-described configuration causes an inconvenience that the other end of the two-ply sheet PJ that is opposite the bonding portion A is not sufficiently separated and that the inner sheet PM (see FIG. 12E) would not be inserted into the other end of the two-ply sheet PJ from the other end of the two-ply sheet PJ. Additionally, the above-described configuration allows the separation claws 16 to easily function as a switcher, that is, to separately guide the first sheet P1 and the second sheet P2 to the first branched sheet conveyance passage K4 and the second branched sheet conveyance passage K5, respectively.

Here, a description is given of the separation claws 16 that functions as a switcher, with reference to FIGS. 7A to 10E.

Figure 7A:
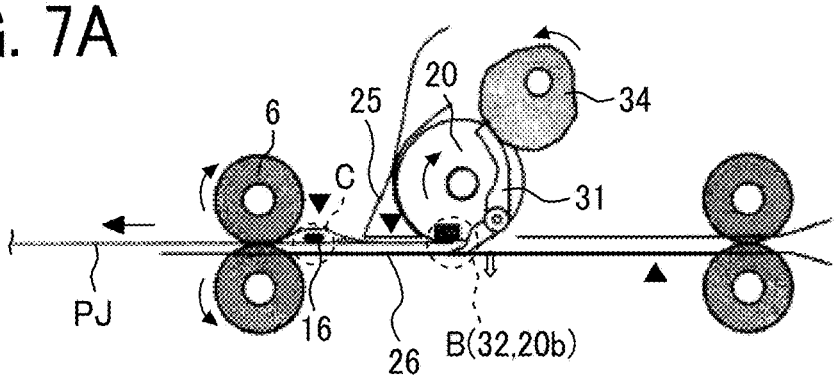
FIGS. 7A to 7C are schematic views, each illustrating the sheet separating operation performed in the sheet laminator, subsequent from the sheet separating operation of each of FIGS. 6A to 6C.
Figure 7B:
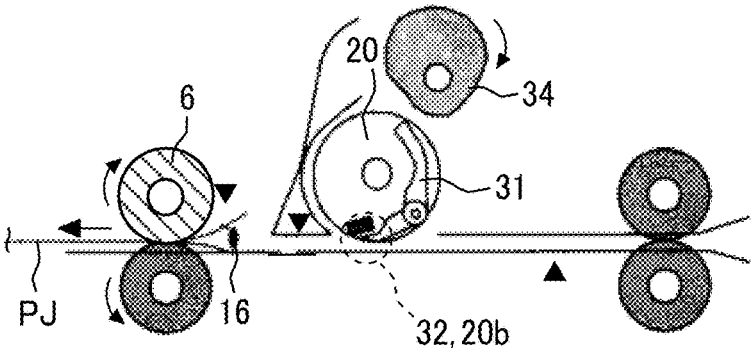
Figure 7C:
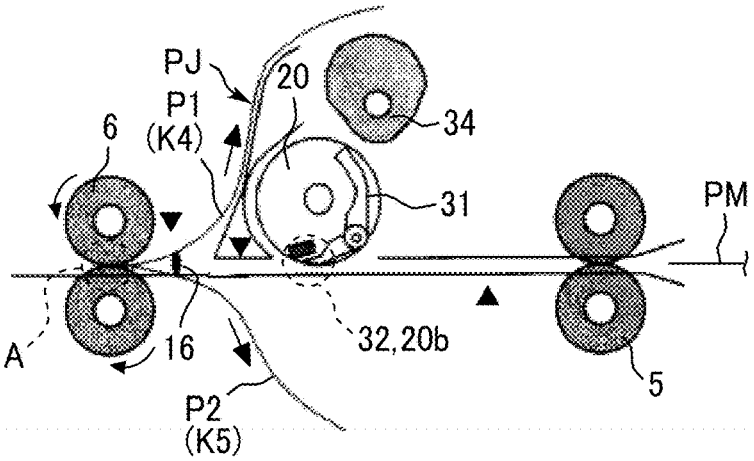

In the present embodiment, the separation claws 16 that functions as a separator also function as a switcher that guides the first sheet P1 and the second sheet P2 separated by the separation claws 16, to the first branched sheet conveyance passage K4 and the second branched sheet conveyance passage K5 branching off in different directions, respectively (see FIG. 7C).

To be more specific, as illustrated in FIG. 7C, the first branched sheet conveyance passage K4 and the second branched sheet conveyance passage K5 branch off in different directions from the third sheet conveyance passage K3 between the winding roller 20 and each of the separation claws 16 (separator). To be more specific, the first branched sheet conveyance passage K4 branches upward from the third sheet conveyance passage K3, and the second branched sheet conveyance passage K5 branches downward from the third sheet conveyance passage K3.

Figure 12C:
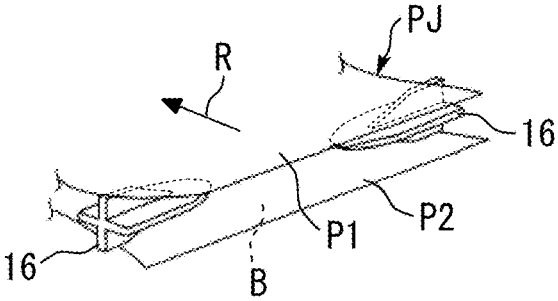
Figure 12D:
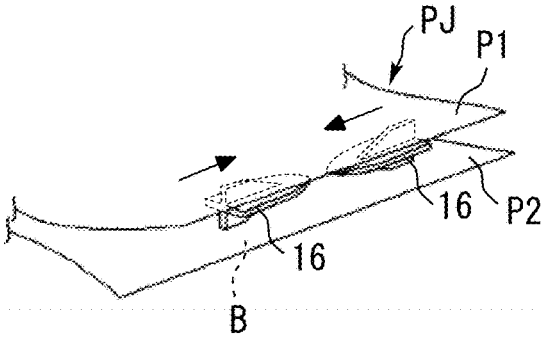

As illustrated in FIGS. 7A to 7C, after the separation claws 16 are inserted into the gap C, the third conveyance roller pair 6 conveys the one end of the two-ply sheet PJ to the left side in FIGS. 7A to 7C so that the winding of the other end of the two-ply sheet PJ on the winding roller 20 is released (see FIG. 12A to FIG. 12C). After the winding of the other end of the two-ply sheet PJ on the winding roller 20 is released, the separation claws 16 move to the center in the width direction of the two-ply sheet PJ as illustrated in FIG. 12D, and stop at the center in the width direction of the two-ply sheet PJ. Then, while the separation claws 16 remain in the above-described state, the third conveyance roller pair 6 conveys the other end of the two-ply sheet PJ to the right side in FIGS. 7A to 7C again. Thereafter, the separation claws 16 guide the first sheet P1 and the second sheet P2 separated by the separation claws 16, to the first branched sheet conveyance passage K4 and the second branched sheet conveyance passage K5, respectively. That is, the first sheet P1 is guided to the first branched sheet conveyance passage K4, and the second sheet P2 is guided to the second branched sheet conveyance passage K5. Subsequently, as illustrated in FIGS. 8A to 8C and 12E, the separation claws 16 move to the standby positions, and the second conveyance roller pair 5 conveys the inner sheet PM to the one end of the third sheet conveyance passage K3, that is, the right side in FIGS. 8A to 8C, to insert the inner sheet PM between the first sheet P1 and the second sheet P2 separated from the two-ply sheet PJ.

As described above, each of the separation claws 16 in the present embodiment functions as a separator that separates (in other words, peels) the non-bonding portion of the first sheet P1 and the second sheet P2 constructing the two-ply sheet PJ, and also functions as a switcher that separately guides the separated two sheets, which are the first sheet P1 and the second sheet P2, to the first branched sheet conveyance passage K4 and the second branched sheet conveyance passage K5, respectively. Accordingly, the above-described configuration reduces the size and cost of the sheet laminator 50, when compared with the configuration of a sheet separation device including the separator and the switcher as different units. That is, the above-described configuration efficiently and reliably separates the first sheet P1 and the second sheet P2 constructing the two-ply sheet PJ.

The seventh sensor 47 optically detects a state in which the first sheet P1 separated apart from the second sheet P2 is successfully conveyed to the first branched sheet conveyance passage K4. Further, the eighth sensor 48 optically detects a state in which the second sheet P2 separated apart from the first sheet P1 is successfully conveyed to the second branched sheet conveyance passage K5.

Note that each separation claw 16 in the present embodiment functions as both a separator and a switcher. However, the sheet separation device 1 according to the present embodiment may further include a member that functions as a switcher, different from the separation claw 16 that functions as a separator.

Here, a description is given of a first guide 25 provided in the sheet separation device 1 according to the present embodiment, with reference, for example, FIGS. 6A to 7C.

The first guide 25 is disposed between the separation claws 16 and the winding roller 20 in the third sheet conveyance passage K3. The first guide 25 functions as a limiter to limit an amount of slack (in other words, a deflection amount) of the first sheet P1 that is wound around the winding roller 20 on the inner side of the first sheet P1 and the second sheet P2 of the two-ply sheet PJ wound around the winding roller 20.

To be more specific, the first guide 25 that functions as a limiter is a conveyance guide disposed on the side in which the winding roller 20 is disposed with respect to an imaginary plane S1, that is, above the imaginary plane S1 in FIG. 6A, in the third sheet conveyance passage K3. The imaginary plane S1 (see FIG. 6A) is an imaginary plane passing through the winding start position W of the winding roller 20 and the nip region of the third conveyance roller pair 6 in the third sheet conveyance passage K3. The first guide 25 has a shape like substantially a triangular prism having a plane along the outer circumferential surface of the winding roller 20, and the plane covers a part of the outer circumferential surface of the winding roller 20 and is separated from the winding roller 20 by a predetermined gap. The first guide 25 functions as a conveyance guide of the third sheet conveyance passage K3 and a conveyance guide of the first branched sheet conveyance passage K4. That is, the first guide 25 guides the sheet conveyed through the third sheet conveyance passage K3, the sheet conveyed through the first branched sheet conveyance passage K4, and the sheet wound around the winding roller 20.

In particular, in the third sheet conveyance passage K3, the first guide 25 limits bending the two-ply sheet PJ upward (in particular, bending the first sheet P1 upward) between the winding roller 20 and the third conveyance roller pair 6. Therefore, the gap C in the two-ply sheet PJ that is mainly formed by bending the first sheet P1 upward is intensively formed between the first guide 25 and the third conveyance roller pair 6. Accordingly, the above-described configuration increases the size of the gap C even if the winding amount of the two-ply sheet PJ wound around the winding roller 20 is not large, and the separation claws 16 smoothly enter the gap C to separate the two-ply sheet PJ.

Now, a description is given of a second guide 26 provided in the sheet separation device 1 according to the present embodiment, with reference to FIGS. 6A to 7C.

The second guide 26 is disposed between the separation claws 16 and the winding roller 20 in the third sheet conveyance passage K3. The second guide 26 functions as a guide to guide the second sheet P2 that is an outer sheet of the two sheets P1 and P2 of the two-ply sheet PJ wound around the winding roller 20.

To be more specific, the second guide 26 that functions as a guide is a sheet conveyance guide disposed on the side in which the winding roller 20 is not disposed with respect to the imaginary plane S1, that is, below the imaginary plane S1 in FIG. 6A, in the third sheet conveyance passage K3. The second guide 26 is disposed to face the lower surface of the sheet from a portion close and upstream from the second conveyance roller pair 5 in the forward direction to a portion downstream from the third conveyance roller pair 6 in the forward direction. That is, the second guide 26 guides the sheet conveyed on the third sheet conveyance passage K3.

In particular, in the third sheet conveyance passage K3 between the winding roller 20 and the third conveyance roller pair 6, a clearance between the first guide 25 and the second guide 26 is set to be a value by which the sheet having the largest thickness is conveyed. Since this setting limits a gap between the first sheet P1 and the second sheet P2 constructing the two-ply sheet PJ so as not to be too large between the first guide 25 and the second guide 26, the gap C in the two-ply sheet PJ that is mainly formed by bending the first sheet P1 upward is intensively formed. Accordingly, the separation claws 16 smoothly enter the gap C to separate the two-ply sheet PJ.

Here, a description is given of the sixth sensor 46, with reference to FIGS. 6A to 7C. The sixth sensor 46 functions as an abnormality detection sensor or an abnormality detector to detect an abnormal state in which the gap C formed between the first sheet P1 and the second sheet P2 at a predetermined position (that is, a position between the third conveyance roller pair 6 and the winding roller 20) is not larger than a predetermined size before the separation claws 16 move from the standby positions, to be more specific, before the separation claws 16 move from the standby positions illustrated in FIG. 15 to the separation positions illustrated in FIGS. 11 and 12A. The predetermined size is the size of the gap C into which the separation claws 16 enter, which is determined by experiments. That is, the sixth sensor 46 that functions as the abnormality detector detects the abnormal state in which the gap C formed between the first sheet P1 and the second sheet P2 at a predetermined position is not larger than the predetermined size before the separation claws 16 are inserted into the gap C.

In other words, at a timing at which the gap C is formed between the first sheet P1 and the second sheet P2, as illustrated in FIGS. 5D, 6A, and 6C, the sixth sensor 46 that functions as the abnormality detector detects the abnormal state such as a state in which the gap is not formed at all or a state in which the gap is not formed as a sufficient gap C.

In the present embodiment, the controller 500 notifies occurrence of an abnormal state when the abnormal state is detected by the sixth sensor 46 (abnormality detector). To be more specific, as illustrated in FIG. 1, the sheet laminator 50 includes an operation display panel 49 that functions as an operation display device on the exterior of the sheet laminator 50 to display various kinds of information about the sheet laminator 50 and input various kinds of commands. When the controller 500 determines the abnormal state based on the results detected by the sixth sensor 46, that is, when the two-ply sheet PJ does not have the sufficiently large gap C, the controller 500 controls the operation display panel 49 to display that the abnormal state is detected. For example, the operation display panel 49 displays "Since an abnormality has occurred, the process of inserting the inner sheet is stopped. Please check the setting direction of the two-ply sheet in the unit sheet feed tray. If the setting direction is correct and similar abnormalities are repeated, please contact a service person."

The above-described sixth sensor 46 that functions as the abnormality detector may be, for example, a lever type sensor that comes into contact with the upper first sheet P1 of the two-ply sheet PJ forming the gap C larger than the predetermined size.

Here, a description is given or the sheet laminating operation on a plurality of two-ply sheets in the sheet laminator 50 according to the present embodiment, with respect to FIGS. 9A to 10C.

As illustrated in FIGS. 9A to 10C, in a case in which the sheet laminator 50 performs the sheet laminating operation on a plurality of two-ply sheets PJ including a preceding two-ply sheet PJ1 and a subsequent two-ply sheet PJ2, when the sheet lamination device 51 is performing the sheet laminating operation on the preceding two-ply sheet PJ1, the sheet separation device 1 that performs the sheet separating operation and the sheet inserting operation performs at least the sheet separating operation on the subsequent two-ply sheet PJ2.

That is, in the present embodiment, when continuously performing the sheet laminating operation on each of the plurality of two-ply sheets PJ (i.e., the preceding two-ply sheet PJ1 and the subsequent two-ply sheet PJ2), the sheet laminator 50 according to the present embodiment does not start the sheet separating operation on the subsequent two-ply sheet PJ2 after completely finishing the sheet laminating operation on the preceding two-ply sheet PJ1 but starts the sheet separating operation on the subsequent two-ply sheet PJ2 while the sheet lamination device 51 is performing the sheet laminating operation on the preceding two-ply sheet PJ1. This sheet laminating operation continuously performed on the plurality of two-ply sheets may hereinafter be referred to as a continuous sheet laminating operation. Further, in other words, the sheet laminator 50 according to the present embodiment narrows the gap (space) between the preceding two-ply sheet PJ1 and the subsequent two-ply sheet PJ2 in the sheet conveyance direction to perform the continuous sheet laminating operation.

Therefore, the time to finish the entire sheet laminating operation (series of jobs) on the plurality of two-ply sheets PJ is reduced, thereby enhancing the productivity of the sheet laminator 50.

Figure 9A:
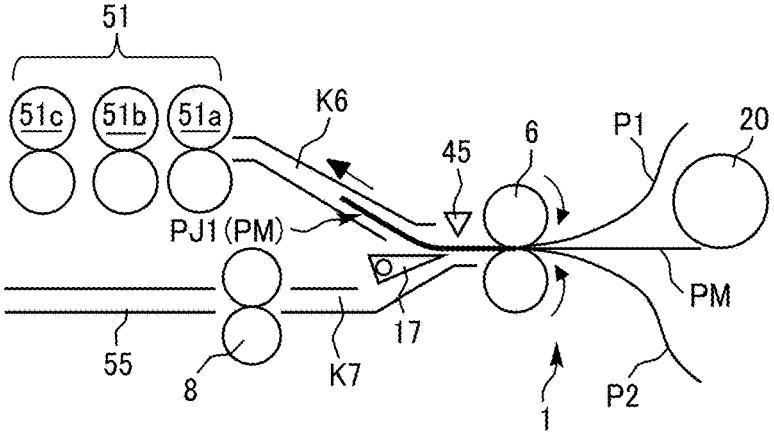
FIGS. 9A to 9D are schematic views, each illustrating the sheet separating operation performed in the sheet laminator, subsequent from the sheet separating operation of each of FIGS. 8A to 8C.
Figure 9B:
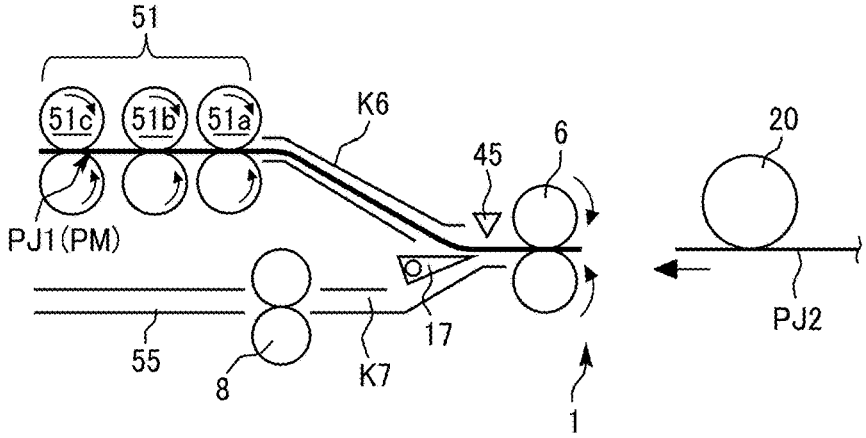
Figure 9C:
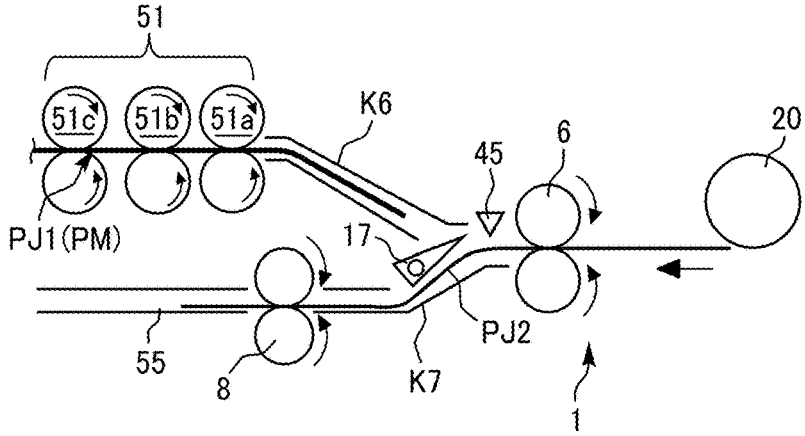
Figure 9D:
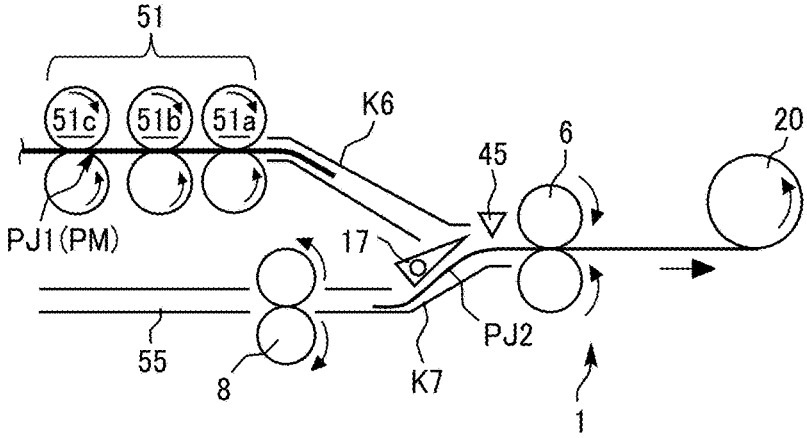
Figure 10A:
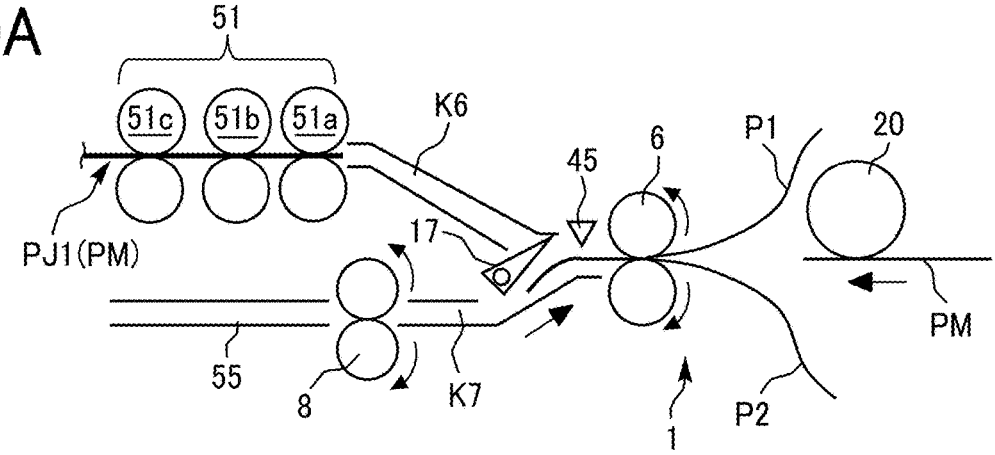
FIGS. 10A to 10C are schematic views, each illustrating the sheet separating operation performed in the sheet laminator, subsequent from the sheet separating operation of each of FIGS. 9A to 9D.

In particular, in the present embodiment, as illustrated in FIGS. 9C, 9D, and 10A, when the sheet separation device 1 performs the sheet separating operation on the subsequent two-ply sheet PJ2 in the continuous sheet laminating operation, the switching claw 17 that functions as a switcher is controlled to be in the second state in which the fourth sheet conveyance passage K6 is closed and the retract sheet conveyance passage K7 is open).

That is, when the sheet separation device 1 performs the sheet separating operation on the subsequent two-ply sheet PJ2, the fourth sheet conveyance passage K6 is closed and, at the same time, the retract sheet conveyance passage K7 is open.

Accordingly, when compared with a configuration in which the retract sheet conveyance passage K7 is not provided and the continuous sheet laminating operation is performed by using the fourth sheet conveyance passage K6 alone, even if the length of the fourth sheet conveyance passage K6 (in the sheet conveyance direction) is shortened (that is, even if the size of the sheet laminator 50 is reduced), the configuration according to the present embodiment prevents the inconvenience in which the subsequent two-ply sheet PJ2 interfere the preceding two-ply sheet PJ1.

Note that the control of changing the position of the switching claw 17 is performed by the fifth sensor 45 disposed proximate to the branching point of the fourth sheet conveyance passage K6 and the retract sheet conveyance passage K7, in response to the timing that the trailing end of the preceding two-ply sheet PJ1 is detected.

Figure 10B:
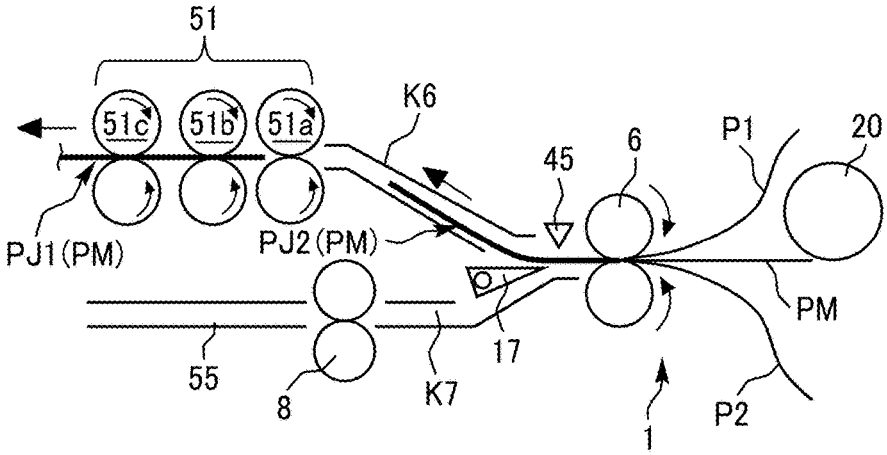
Figure 10C:
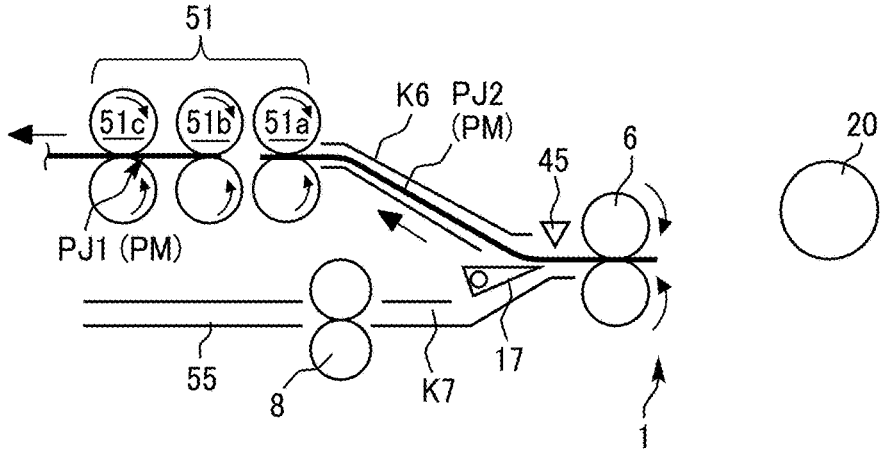

Further, as illustrated in FIGS. 10A to 10C, the continuous sheet laminating operation in the present embodiment is controlled that the trailing end of the preceding two-ply sheet PJ1 passes the extreme upstream portion of the sheet lamination device 51 (that is, the nip region formed between the rollers of a first heat-pressure roller pair 51*a* that is one of the plurality of heat-pressure roller pairs 51*a*, 51*b*, and 51*c* and is an extreme-upstream heat-pressure roller pair disposed extreme upstream of the plurality of heat-pressure roller pairs 51*a*, 51*b*, and 51*c* of the sheet lamination device 51 in the sheet conveyance direction), and then the leading end of the subsequent two-ply sheet PJ2 enters the extreme upstream portion (i.e., the nip region of the first heat-pressure roller pair 51*a*). In other words, the controller 500 causes the leading end of the subsequent two-ply sheet PJ2 to enter the extreme upstream portion of the sheet lamination device 51 in the sheet conveyance direction after the trailing end of the preceding two-ply sheet PJ1 passed the extreme upstream portion of the sheet lamination device 51.

Therefore, the continuous sheet laminating operation is performed in a state in which the gap (space) between the preceding two-ply sheet PJ1 and the subsequent two-ply sheet PJ2 is further reduced (narrowed). Accordingly, the time to finish the entire sheet laminating operation (series of jobs) on the plurality of two-ply sheets PJ is reduced, thereby enhancing the productivity of the sheet laminator 50.

Now, a description is given of the operations performed in the sheet laminator 50 when the sheet laminating operation is performed continuously on the plurality of two-ply sheets PJ, with reference to FIGS. 4A to 10C.

Further, in the description of the operations, the operations of the separation claws 16 are appropriately described with reference to FIGS. 11 to 12E, and the control flow is described with reference to a flowchart of FIG. 13 including FIGS. 13A and 13B and FIG. 14.

Figures 13, 13A:
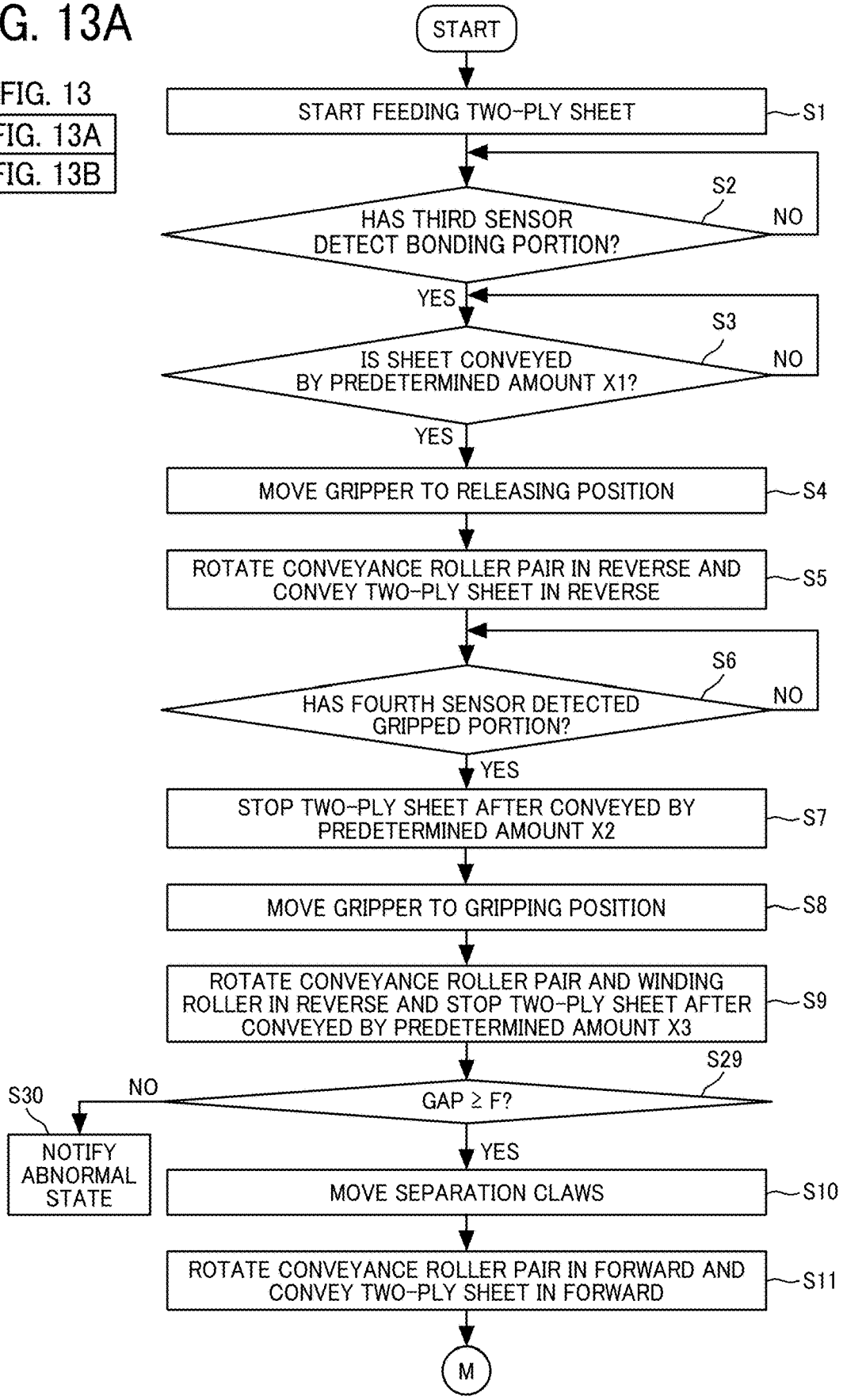
FIG. 13 including
FIGS. 13A and 13B is a flowchart illustrating a flow of a control process executed in the sheet laminator.

First, the first feed roller 2 and the first conveyance roller pair 4 start feeding the two-ply sheet PJ (that is a preceding two-ply sheet PJ1) from the first feed tray 11 in step S1 of FIG. 13A. Then, as illustrated in FIG. 4A, the second conveyance roller pair 5 conveys the two-ply sheet PJ with the bonding portion A as a leading end of the two-ply sheet PJ in the forward direction that is a direction from the right side to the left side in FIGS. 4A to 4D in the third sheet conveyance passage K3.

At this time, the controller 500 controls the moving mechanism 30 so that the gripper 32 is positioned at the gripping position. That is, the cam 34 moves to a rotational position at which the cam 34 does not press the arm 31. When the gripper 32 is positioned at the gripping position as described above, the gripper 32 does not block conveyance of the sheet in the third sheet conveyance passage K3. The separation claws 16 stand by at the standby positions (illustrated in FIG. 12A) at which the separation claws 16 do not block conveyance of the sheet in the third sheet conveyance passage K3.

Then, as illustrated in FIG. 4B, the controller 500 determines whether the third sensor 43 has detected the bonding portion A of the two-ply sheet PJ (that is the leading end of the two-ply sheet PJ conveyed in the forward direction, in other words, the one end of the two-ply sheet PJ), in step S2 of FIG. 13A. When the third sensor 43 has not detected the bonding portion A of the two-ply sheet PJ (NO in step S2 of FIG. 13A), step S2 is repeated until the third sensor 43 detects the bonding portion A of the two-ply sheet PJ. By contrast, when the third sensor 43 has detected the bonding portion A of the two-ply sheet PJ (YES in step S2 of FIG. 13A), in response to the timing of detection of the bonding portion A of the two-ply sheet PJ by the third sensor 43, the controller 500 causes the third conveyance roller pair 6 to convey the two-ply sheet PJ in the forward direction by a predetermined amount X1 until the gripped portion B of the two-ply sheet PJ (that is the trailing end of the two-ply sheet PJ conveyed in the forward direction, in other words, the other end of the two-ply sheet PJ) passes the position of the winding roller 20, in step S3 of FIG. 13A. Note that, in a case in which the two-ply sheet PJ is the subsequent two-ply sheet PJ2 (that is, the second or other two-ply sheet after the first two-ply sheet) in the continuous sheet laminating operation in the above-described state, the switching claw 17 (see FIGS. 9A to 9C) is rotated to the position to close the fourth sheet conveyance passage K6 and open the retract sheet conveyance passage K7).

As illustrated in FIG. 4C, the controller 500 causes the third conveyance roller pair 6 to temporarily stop conveyance of the two-ply sheet PJ conveyed by the predetermined amount X1 and causes the gripper 32 to move from the gripping position to the releasing position in step S4 of FIG. 13A. That is, the cam 34 moves to a rotational position at which the cam 34 presses the arm 31. In this state, the gripped portion B of the two-ply sheet PJ is received between the gripper 32 and the receiving portion 20*b*.

Then, as illustrated in FIG. 4D, the controller 500 causes the third conveyance roller pair 6 to rotate in the reverse direction to start conveyance of the two-ply sheet PJ in the reverse direction in step S5 of FIG. 13A. At this time, the fourth sensor 44 detects the gripped portion B of the two-ply sheet PJ, that is, the other end of the two-ply sheet PJ and the leading end of the two-ply sheet PJ conveyed in the reverse direction.

Subsequently, the controller 500 determines whether the fourth sensor 44 has detected the gripped portion B of the two-ply sheet PJ, in step S6 of FIG. 13A. When the fourth sensor 44 has not detected the gripped portion B (NO in step S6 of FIG. 13A), step S6 is repeated until the fourth sensor 44 detects the gripped portion B of the two-ply sheet PJ. By contrast, when the fourth sensor 44 has detected the gripped portion B (YES in step S6 of FIG. 13A), as illustrated in FIG. 5A, in response to the timing of detection of the gripped portion B of the two-ply sheet PJ by the fourth sensor 44, the controller 500 causes the third conveyance roller pair 6 to convey the two-ply sheet PJ by a predetermined amount X2 until the gripped portion B of the two-ply sheet PJ reaches the position of the winding roller 20, that is, the winding start position W. Then, the controller 500 causes the third conveyance roller pair 6 to stop conveyance of the two-ply sheet PJ, in step S7 of FIG. 13A.

Then, as illustrated in FIG. 5B, the gripper 32 is moved from the releasing position to the gripping position in the state in which the gripped portion B of the two-ply sheet PJ is at the winding start position W, in step S8 of FIG. 13A. That is, the cam 34 moves to a rotational position at which the cam 34 does not press the arm 31. In this state, as illustrated in FIG. 5B', the end surface of the other end of the two-ply sheet PJ does not contact any member, and the gripped portion B of the two-ply sheet PJ is gripped between the gripper 32 and the receiving portion 20*b*.

Then, as illustrated in FIG. 5C, the winding roller 20 rotates in the reverse direction (that is, the counterclockwise direction) in a state in which the gripper 32 grips the two-ply sheet PJ, and the third conveyance roller pair 6 rotates again in the reverse direction together with the winding roller 20. At this time, as the winding roller 20 rotates, the gap C is formed between the first sheet P1 and the second sheet P2 of the two-ply sheet PJ between the winding roller 20 and the third conveyance roller pair 6, as illustrated in FIG. 5D. At this time, as the gap C is formed, the first guide 25 and the second guide 26 limit the warp (slack) of the two-ply sheet PJ in the vicinity of the winding roller 20. Accordingly, the gap C of the two-ply sheet PJ is intensively formed near the third conveyance roller pair 6.

Since the controller 500 determines the timing at which the gripper 32 and the receiving portion 20*b* grip the gripped portion B of the two-ply sheet PJ in response to the timing of detection of the leading end of the two-ply sheet PJ conveyed in the reverse direction by the fourth sensor 44 disposed downstream from the third conveyance roller pair 6 in the reverse direction, the gripped portion B of the two-ply sheet PJ is accurately conveyed to a desired gripping position regardless of variations in the sheet lengths with respect to the sheet conveyance amount X2. Note that the size of sheets includes an error even if the sheets are sold as the same size.

Further, by detecting the leading end of the two-ply sheet PJ conveyed in the reverse direction by the fourth sensor 44, the sheet conveyance amount X2 that is measured according to the detection is reduced regardless of the sheet length. Therefore, the above-described configuration reduces variation in the sheet conveyance amount X2 and accurately conveys the gripped portion B of the two-ply sheet PJ to the desired gripping position.

Accordingly, the fourth sensor 44 is preferably disposed near the winding roller 20.

Further, a description is given of a mechanism that generates the gap C in the two-ply sheet PJ, with reference to FIG. 5C'. The gap C is generated in the two-ply sheet PJ between the winding roller 20 and the third conveyance roller pair 6 by winding the two-ply sheet PJ around the winding roller 20.

The following description additionally indicates the mechanism.

The two-ply sheet PJ wound around the winding roller 20 is gripped by the gripper 32, restricting misalignment in the sheet. Therefore, a slip is generated between the first sheet P1 and the second sheet P2 by the amount of the circumferential length of the winding roller 20. As a result, the conveyance amount of the inner sheet (i.e., the first sheet P1) is smaller than the conveyance amount of the outer sheet (i.e., the second sheet P2). As a result, warp (slack) is generated in the inner sheet (i.e., the first sheet P1) between the nip region of the third conveyance roller pair 6 and the winding roller 20. At this time, as the two-ply sheet PJ is wound around the winding roller 20 one or more rounds, the difference in the winding circumferential length is generated between the inner circumference and the outer circumference additionally by the thickness of the sheet, which generates the warp (slack).

To be more specific, a distance from the rotary shaft 20*a* (i.e., the axial center) of the winding roller 20 to the second sheet P2 on the outer side of the winding roller 20 is $R+\Delta R$, where a distance from the rotary shaft 20*a* (i.e., the axial center) of the winding roller 20 to the first sheet P1 on the inner side of the winding roller 20 is "R" and the thickness of the inner sheet (first sheet P1) is "A R". Since the radius of the first sheet P1 wound around the inner side of the winding roller 20 and the radius of the second sheet P2 wound around the outer side of the first sheet P1 are different by the thickness A R of the first sheet P1 (wound around the inner side of the winding roller 20), a circumferential length difference of $2\times\Delta R\times\pi$ is generated between the inner sheet (first sheet P1) and the outer sheet (second sheet P2), when the two-ply sheet PJ is wound around the winding roller 20 by one round. Therefore, when the number of winding the two-ply sheet PJ around the winding roller 20 is M times, the slack of the inner sheet (first sheet P1) is generated by the circumferential length difference of $2\times\Delta R\times\pi\times M$.

Finally, the warp (slack) is accumulated between the third conveyance roller pair 6 and the winding roller 20, and the gap C corresponding to $2\times\Delta R\times\pi\times M$ is formed between the first sheet P1 and the second sheet P2.

Then, the controller 500 causes the third conveyance roller pair 6 and the winding roller 20 to rotate in the reverse direction. At the timing at which the third conveyance roller pair 6 has conveyed the two-ply sheet PJ by a predetermined amount X3 since the start of winding of the two-ply sheet PJ by the winding roller 20, the controller 500 causes the third conveyance roller pair 6 to stop conveyance of the two-ply sheet PJ and the winding roller 20 to stop winding the two-ply sheet PJ, as illustrated in FIG. 6A, in step S9 of FIG. 13A. In this state, the two-ply sheet PJ is wound around the winding roller 20 one or more times, and the gap C in the two-ply sheet PJ (i.e., the distance between the first sheet P1 and the second sheet P2 in the vertical direction) is sufficiently widened if the two-ply sheet PJ is normally separated.

When the gap C is sufficiently widened, the controller 500 determines whether the sixth sensor 46 detects that the gap C equal to or larger than a predetermined distance F is formed in the two-ply sheet PJ, in step S29 of FIG. 13A.

As a result, when the controller 500 determines that the gap C is the sufficiently large gap equal to or greater than the predetermined size F, the controller 500 determines that the subsequent sheet separating operations of the separation claws 16 do not cause a problem and controls the separation claws 16 to insert into the gap C sufficiently widened in the two-ply sheet PJ, as illustrated in FIG. 6B, in step S10 of FIG. 13A. That is, as illustrated in FIGS. 11 and 12A, each of the separation claws 16 in pair is moved from the standby position to the separation position.

Then, as illustrated in FIG. 6C, the third conveyance roller pair 6 and the winding roller 20 start rotating in the forward direction, that is, in the clockwise direction, in step S11 of FIG. 13A, in the state in which the separation claws 16 are inserted in the gap C. That is, as illustrated in FIGS. 12A to 12C, the separation claws 16 that is inserted in the gap C of the two-ply sheet PJ relatively move from the one end (bonding portion A) to the other end (gripped portion B) with respect to the two-ply sheet PJ. Note that the above-described relative movement in the present embodiment is achieved by moving the two-ply sheet PJ itself in a direction indicated by arrow in FIGS. 12A to 12C without changing the positions of the separation claws 16 in the sheet conveyance direction.

Note that, when the controller 500 determines that the gap C in the two-ply sheet PJ is not the sufficiently large gap equal to or greater than the predetermined distance F (NO in step S29 of FIG. 13A), that is, when the controller 500 determines that the abnormal state occurs based on the results detected by the sixth sensor 46, the controller 500 determines that the subsequent sheet separating operations of the separation claws 16 cause various kinds of problems, and therefore does not move the separation claws 16 from the standby positions to the separation positions. At this time, the controller 500 causes the operation display panel 49 (see FIG. 1) to notify that the occurrence of the abnormal state stops the sheet separating operation of the two-ply sheet PJ and the sheet inserting operation of the inner sheet PM, in step S30 of FIG. 13A.

Figure 13B:
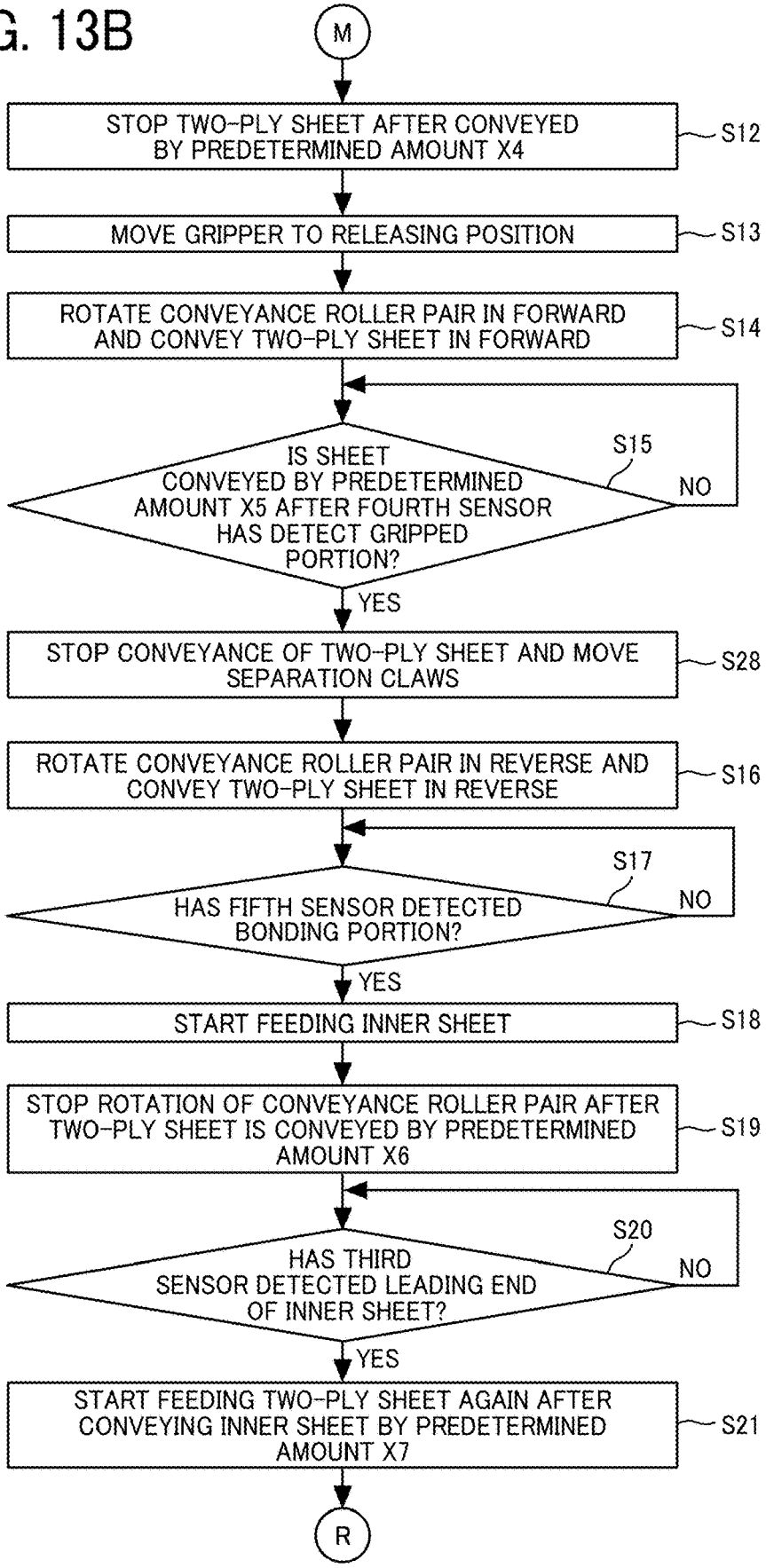

Thereafter, as illustrated in FIG. 7A, the controller 500 causes the third conveyance roller pair 6 and the winding roller 20 to stop rotating in the forward direction after the third conveyance roller pair 6 has conveyed the two-ply sheet PJ in the forward direction by a predetermined amount X4, in step S12 of FIG. 13B. At this time, the gripped portion B of the two-ply sheet PJ is positioned on the third sheet conveyance passage K3 (that is, at the winding start position W illustrated in FIG. 5B), which is a state in which the gripper 32 may release the gripped portion B. In addition, as illustrated in FIG. 12C, the separation claws 16 stop near the other end of the two-ply sheet PJ after the separation claws 16 are inserted into the gap C of the two-ply sheet PJ and relatively move to the other end (gripped portion B) of the two-ply sheet PJ with respect to the two-ply sheet PJ.

In this state, the gripper 32 moves from the gripping position to the releasing position in step S13 of FIG. 13B. That is, the cam 34 moves to a rotational position at which the cam 34 does not press the arm 31. This state indicates that the gripper 32 releases the two-ply sheet PJ from the gripping. Note that, in the present embodiment, the cam 34 in the moving mechanism 30 moves to release the gripping of the gripper 32. However, in a case in which the pulling force by conveyance of the two-ply sheet PJ by the third conveyance roller pair 6 is greater than the gripping force of the gripper 32 to grip the two-ply sheet PJ, the gripping of the two-ply sheet PJ by the gripper 32 is released by pulling the two-ply sheet PJ from the gripper 32 due to conveyance of the two-ply sheet PJ without moving the cam 34 in the moving mechanism 30.

Thereafter, as illustrated in FIG. 7B, the controller 500 causes the third conveyance roller pair 6 to rotate in the forward direction again to start conveyance of the two-ply sheet PJ in the forward direction, in step S14 of FIG. 13B. In addition, after the gripped portion B of the two-ply sheet PJ, that is, the other end of the two-ply sheet PJ and the trailing end of the two-ply sheet PJ, passes over the branch portion between the third sheet conveyance passage K3 and each of the first branched sheet conveyance passage K4 and the second branched sheet conveyance passage K5, the gripper 32 moves from the releasing position to the gripping position. Further, at this time, the fourth sensor 44 detects the gripped portion B of the two-ply sheet PJ, that is, the other end of the two-ply sheet PJ and the trailing end of the two-ply sheet PJ conveyed in the forward direction. Then, the controller 500 determines whether the third conveyance roller pair 6 is conveyed the two-ply sheet PJ by a predetermined amount X5 in response to the timing at which the fourth sensor 44 detects the trailing end of the two-ply sheet PJ conveyed in the forward direction, in other words, after the fourth sensor 44 has detected the gripped portion B of the two-ply sheet PJ, in step S15 of FIG. 13B. When the third conveyance roller pair 6 is not conveyed the two-ply sheet PJ by the predetermined amount X5 after the fourth sensor 44 has detected the gripped portion B of the two-ply sheet PJ (NO in step S15 of FIG. 13B), step S15 is repeated until the third conveyance roller pair 6 is conveyed the two-ply sheet PJ by the predetermined amount X5 after the fourth sensor 44 has detected the gripped portion B of the two-ply sheet PJ. By contrast, when the third conveyance roller pair 6 is conveyed the two-ply sheet PJ by the predetermined amount X5 after the fourth sensor 44 has detected the gripped portion B of the two-ply sheet PJ (YES in step S15 of FIG. 13B), as illustrated in FIG. 12D, the controller 500 causes the third conveyance roller pair 6 to stop conveying the two-ply sheet PJ and causes the separation claws 16 to move in the width direction of the two-ply sheet PJ, in step S28 of FIG. 13B. As a result, as illustrated in FIG. 7B, the trailing ends of the first sheet P1 and the second sheet P2 of the two-ply sheet PJ conveyed in the forward direction are separated and largely opened (see FIG. 12D). At this time, the controller 500 starts to perform the sheet separating operation (sheet separation) on the two-ply sheet PJ.

Then, as illustrated in FIG. 7C, the third conveyance roller pair 6 rotates in the reverse direction to start conveying the two-ply sheet PJ in the reverse direction, in step S16 of FIG. 13B. At this time, since the separation claws 16 are disposed at the switching positions at which the separation claws 16 block the two-ply sheet PJ moving to the third sheet conveyance passage K3 (that is, the position illustrated in FIG. 12D), the first sheet P1 and the second sheet P2 separated each other are guided to the first branched sheet conveyance passage K4 and the second branched sheet conveyance passage K5, respectively, as illustrated in FIG. 7C. At this time, the fifth sensor 45 (see FIG. 1) detects the bonding portion A of the two-ply sheet PJ, that is, the one end of the two-ply sheet PJ and the trailing end of the two-ply sheet PJ conveyed in the reverse direction. Subsequently, the controller 500 determines whether the fifth sensor 45 (see FIG. 1) that functions as a sheet detector has detected the trailing end of the two-ply sheet PJ conveyed in the reverse direction, that is, the bonding portion A, in step S17 of FIG. 13B. In response to the timing of detection of the trailing end of the two-ply sheet PJ in the reverse direction by the fifth sensor 45 (see FIG. 1), the controller 500 causes the second feed roller 3 to start feeding the inner sheet PM from the second feed tray 12, in step S18 of FIG. 13B.

Note that the timing at which a sheet feed roller 197 starts to feed the inner sheet PM is not limited to the above-described timing. It is preferable to set the timing to reduce the time to perform the sheet separating operation and the sheet inserting operation.

Figure 8A:
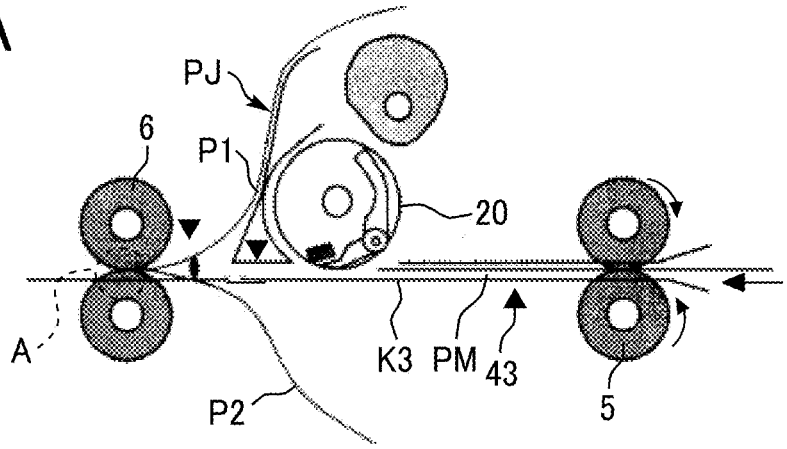
FIGS. 8A to 8C are schematic views, each illustrating the sheet separating operation performed in the sheet laminator, subsequent from the sheet separating operation of each of FIGS. 7A to 7C.

Subsequently, as illustrated in FIG. 8A, in response to the timing of detection of the trailing end of the two-ply sheet PJ in the reverse direction by the fifth sensor 45 (see FIG. 1), the controller 500 causes the third conveyance roller pair 6 to rotate to convey the two-ply sheet PJ by a predetermined amount X6, and stop the conveyance of the two-ply sheet PJ when the two-ply sheet PJ has been conveyed by the predetermined amount X6, in step S19 of FIG. 13B. When the third conveyance roller pair 6 conveys the two-ply sheet PJ by the predetermined amount X6, the bonding portion A of the two-ply sheet PJ is in the nip region of the third conveyance roller pair 6 or at a position slightly leftward from the nip region of the third conveyance roller pair 6. That is, the third conveyance roller pair 6 nips the one end of the two-ply sheet PJ. Then, this state is a state in which the sheet separating operation of the two-ply sheet PJ is completed.

Further, before completion of the sheet separating operation of the two-ply sheet PJ, the controller 500 has already started feeding the inner sheet PM from the second feed tray 12. Therefore, as illustrated in FIG. 8A, when the sheet separating operation on the two-ply sheet PJ is completed, the leading end of the inner sheet PM (i.e., at one end of the inner sheet PM in the forward direction) has approached the position at which the inner sheet PM is inserted between the first sheet P1 and the second sheet P2 constructing the two-ply sheet PJ.

Figure 8B:
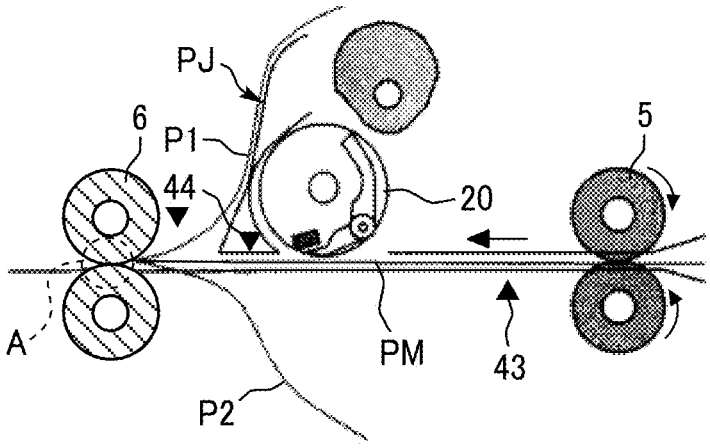

On the other hand, the third sensor 43 detects the leading end of the inner sheet PM (i.e., at one end of the inner sheet PM in the forward direction). In addition, as illustrated in FIG. 8B, in response to the detection timing, the separation claws 16 move to the respective standby positions at the timing at which the separation claws 16 do not block conveyance of the inner sheet PM.

Figure 8C:
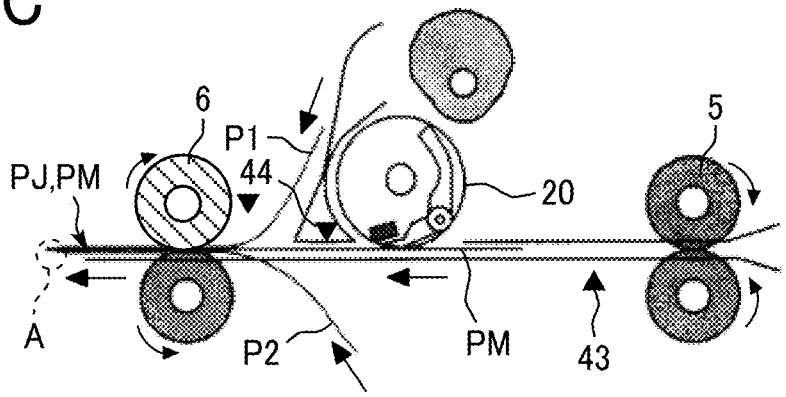
Figure 12E:
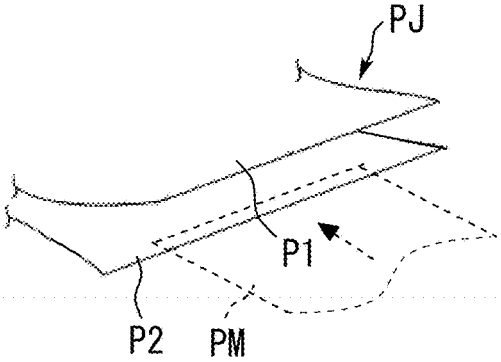

Further, as illustrated in FIGS. 8C and 12E, the controller 500 determines whether the third sensor 43 has detected the leading end of the inner sheet PM in the forward direction, in step S20 of FIG. 13B. When the third sensor 43 has not detected the leading end of the inner sheet PM in the forward direction (NO in step S20 of FIG. 13B), step S20 is repeated until the third sensor 43 has not detected the leading end of the inner sheet PM in the forward direction. By contrast, when the third sensor 43 has detected the leading end of the inner sheet PM in the forward direction (YES in step S20 of FIG. 13B), in response to the detection timing, the controller 500 causes the second conveyance roller pair 5 to convey the inner sheet PM by a predetermined amount X7. Then, the controller 500 causes the third conveyance roller pair 6 to start conveying the two-ply sheet PJ in the forward direction again, in step S21 of FIG. 13B. At this time, the inner sheet PM is accurately nipped at a desired position between the first sheet P1 and the second sheet P2 of the two-ply sheet PJ.

Figure 14:
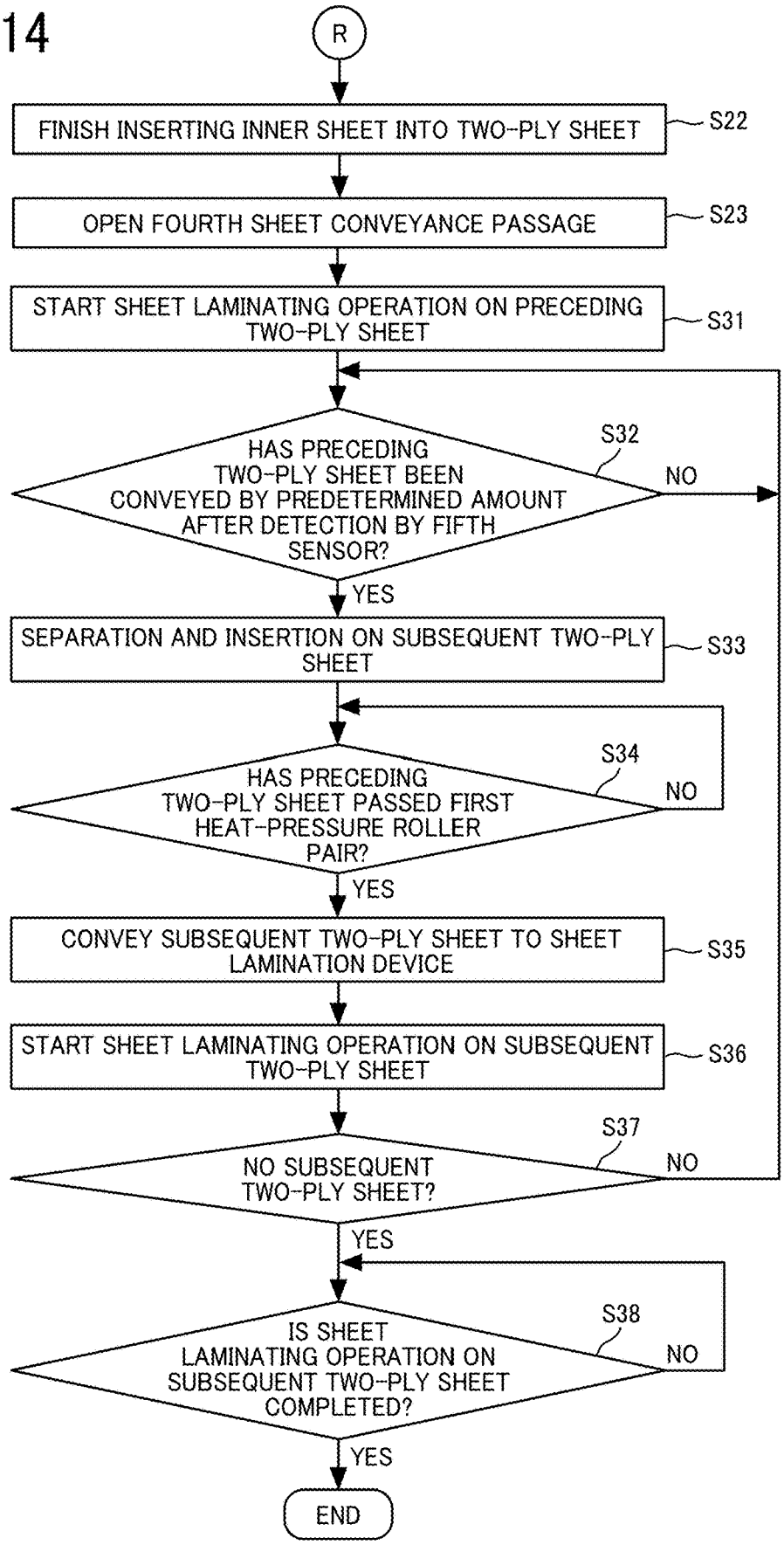
FIG. 14 is a flowchart illustrating the flow of the control process subsequent from FIG. 13.

Thus, the controller 500 finishes the sheet inserting operation to insert the inner sheet PM in the two-ply sheet PJ, in other words, between the first sheet P1 and the second sheet P2 of the two-ply sheet PJ (step S22 of FIG. 14).

At this time, as illustrated in FIG. 9A, the switching claw 17 (see FIG. 1) opens the fourth sheet conveyance passage K6 (in step S23 of FIG. 14). Thereafter, the controller 500 causes the third conveyance roller pair 6 to convey the two-ply sheet PJ (in which the inner sheet PM has been inserted after the sheet separating operation) to pass through the fourth sheet conveyance passage K6, and is then conveyed to the sheet lamination device 51.

Then, as illustrated in FIG. 9B, the sheet lamination device 51 starts to perform the sheet laminating operation on the two-ply sheet PJ (i.e., the preceding two-ply sheet PJ1) (in step S31 of FIG. 14). That is, while the two-ply sheet PJ (i.e., the preceding two-ply sheet PJ1) is conveyed in the sheet lamination device 51, the entire area of the two-ply sheet PJ is gradually bonded with the inner sheet PM being inserted in the two-ply sheet PJ. At this time, the subsequent two-ply sheet PJ2 (before separation) is conveyed from the first feed tray 11 to the sheet separation device 1 without interfering the preceding two-ply sheet PJ1.

Then, as illustrated in FIG. 9C, after the fifth sensor 45 detects the trailing end of the preceding two-ply sheet PJ1 (that is the trailing end of the preceding two-ply sheet PJ1 conveyed in the forward direction, in other words, the other end of the preceding two-ply sheet PJ1), the controller 500 determines whether the preceding two-ply sheet PJ1 is conveyed by a predetermined amount X8 (in step S32 of FIG. 14). When the preceding two-ply sheet PJ1 is not conveyed by the predetermined amount X8 (NO in step S32 of FIG. 14), step S32 is repeated until the preceding two-ply sheet PJ1 is conveyed by the predetermined amount X8. By contrast, when the preceding two-ply sheet PJ1 is conveyed by the predetermined amount X8 (YES in step S32 of FIG. 14), in response to this timing of detection of conveyance of the preceding two-ply sheet PJ1, the sheet separating operation is started on the two-ply sheet PJ2 (step S33 of FIG. 14). This timing indicates a timing at which the trailing end of the preceding two-ply sheet PJ1 passes the branching point of the fourth sheet conveyance passage K6 and the retract sheet conveyance passage K7. At this time, as illustrated in FIG. 9C, the switching claw 17 closes the fourth sheet conveyance passage K6 and the opens the retract sheet conveyance passage K7. Then, the third conveyance roller pair 6 and the second ejection roller pair 8, each rotating in arrow in FIG. 9C, guide the subsequent two-ply sheet PJ2 into the retract sheet conveyance passage K7 to convey the subsequent two-ply sheet PJ2 to the second ejection tray 55 (retract portion). At this time, the trailing end of the subsequent two-ply sheet PJ2 (gripped portion B) may not be located upstream from the winding start position W of the winding roller 20 (see FIG. 5B). A part of the subsequent two-ply sheet PJ2, which is protruded upstream from the third conveyance roller pair 6 in the sheet conveyance direction, is temporarily purged into the retract sheet conveyance passage K7.

Then, as illustrated in FIG. 9C, the controller 500 causes each of the winding roller 20, the third conveyance roller pair 6, and the second ejection roller pair 8 to rotate in the direction indicated by arrow in FIG. 9C, so that the subsequent two-ply sheet PJ2 is wound around the winding roller 20.

Further, as illustrated in FIG. 10A, the controller 500 starts to peel (separate) the first sheet P1 and the second sheet P2 constructing the subsequent two-ply sheet PJ2 and to feed the inner sheet PM from the second feed tray 12. The inner sheet PM is to be inserted into the subsequent two-ply sheet PJ2. The series of the sheet separating operation and the sheet inserting operation performed on the subsequent two-ply sheet PJ2 is same as the series of the sheet separating operation and the sheet inserting operation performed on the preceding two-ply sheet PJ1, which was described with reference to FIGS. 4A to 8C.

Then, as illustrated in FIG. 10B, the controller 500 determines whether the preceding two-ply sheet PJ1 passed through the nip region (the extreme upstream portion) of the first heat-pressure roller pair 51*a* (in step S34 of FIG. 14). When the preceding two-ply sheet PJ1 has not passed through the nip region (the extreme upstream portion) of the first heat-pressure roller pair 51*a* (NO in step S34), step S34 is repeated until the preceding two-ply sheet PJ1 passes through the nip region of the first heat-pressure roller pair M a. On the other hand, when the preceding two-ply sheet PJ1 passed through the nip region of the first heat-pressure roller pair 51*a* (YES in step S34), in response to the timing at which the trailing end of the preceding two-ply sheet PJ1 passes through the nip region of the first heat-pressure roller pair 51*a*, the subsequent two-ply sheet PJ2 in which the inner sheet PM being inserted is conveyed toward the sheet lamination device 51 (in step S35 of FIG. 14). At this time, the switching claw 17 is rotated to the position to open the fourth sheet conveyance passage K6 and close the retract sheet conveyance passage K7. Note that, in the present embodiment, the timing at which the trailing end of the preceding two-ply sheet PJ1 passes through the nip region of the first heat-pressure roller pair 51*a* is determined based on the timing at which the fifth sensor 45 detected the trailing end of the preceding two-ply sheet PJ1. However, the timing at which the trailing end of the preceding two-ply sheet PJ1 passes through the nip region of the first heat-pressure roller pair 51*a* may be determined based on the rotation time of the first heat-pressure roller pair 51*a*. Alternatively, a sheet detection sensor may be disposed proximate to the first heat-pressure roller pair 51*a* to directly detect the trailing end of the preceding two-ply sheet PJ1.

Then, as illustrated in FIG. 10C, the controller 500 causes the sheet lamination device 51 to start to perform the sheet laminating operation on the subsequent two-ply sheet PJ2 (step S36 in FIG. 14). Further, after the sheet laminating operation is performed on the preceding two-ply sheet PJ1, the preceding two-ply sheet PJ1 is ejected to the outside of the image forming apparatus 100 by the first ejection roller pair 7 and is stacked on the first ejection tray 13.

Thereafter, the controller 500 determines whether or not there is no two-ply sheet following the subsequent two-ply sheet PJ2 (another subsequent two-ply sheet) (in step S37 of FIG. 14). When there is another two-ply sheet following the subsequent two-ply sheet PJ2 (NO in step S37), step goes back to step S32 and steps S32 to S37 are repeated until no more two-ply sheet is detected.

By contrast, when there is no two-ply sheet following the subsequent two-ply sheet PJ2 (YES in step S37), the controller 500 determines whether the sheet laminating operation on the subsequent two-ply sheet PJ2 is finished (in step S38 of FIG. 14). When the sheet laminating operation on the subsequent two-ply sheet PJ2 is not finished (NO in step S38), step S38 is repeated until it is determined that the sheet laminating operation on the subsequent two-ply sheet PJ2 is finished. On the other hand, when the sheet laminating operation on the subsequent two-ply sheet PJ2 is finished (YES in step S38), the subsequent two-ply sheet PJ2 is ejected and stacked on the first ejection tray 13, and the flow in FIG. 14 ends.

As described above, the sheet laminator 50 according to the present embodiment performs the sheet laminating operation as a sequence of the following operations: an operation to feed the two-ply sheet PJ; an operation to separate the first sheet P1 and the second sheet P2 of the two-ply sheet PJ; an operation to insert the inner sheet PM into the space between the first sheet P1 and the second sheet P2; and an operation to perform the sheet laminating operation on the two-ply sheet PJ in which the inner sheet PM is inserted. By so doing, the user convenience for the sheet laminator 50 is enhanced. Further, in a case in which the sheet laminator 50 performs the sheet laminating operation on a plurality of two-ply sheets PJ including the preceding two-ply sheet PJ1 and the subsequent two-ply sheet PJ2, when the sheet laminating operation is performed on the preceding two-ply sheet PJ1, the sheet separating operation is performed on the subsequent two-ply sheet PJ2. Accordingly, the productivity of the sheet laminator 50 and the image forming apparatus 100 is enhanced.

Variation 1

A description is given of the continuous sheet laminating operation of the sheet laminator 50 according to Variation 1.

Figure 16A:
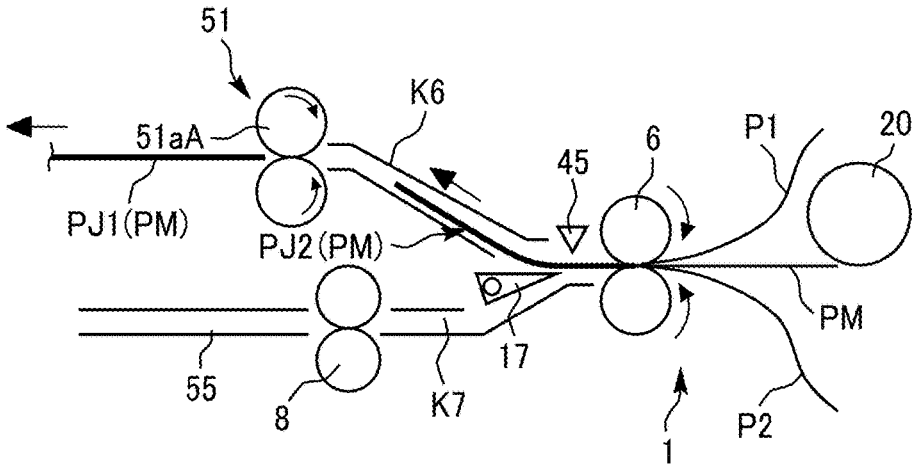
FIGS. 16A and 16B are schematic views, each illustrating a part of operation in a sheet laminator, according to Variation 1.
Figure 16B:
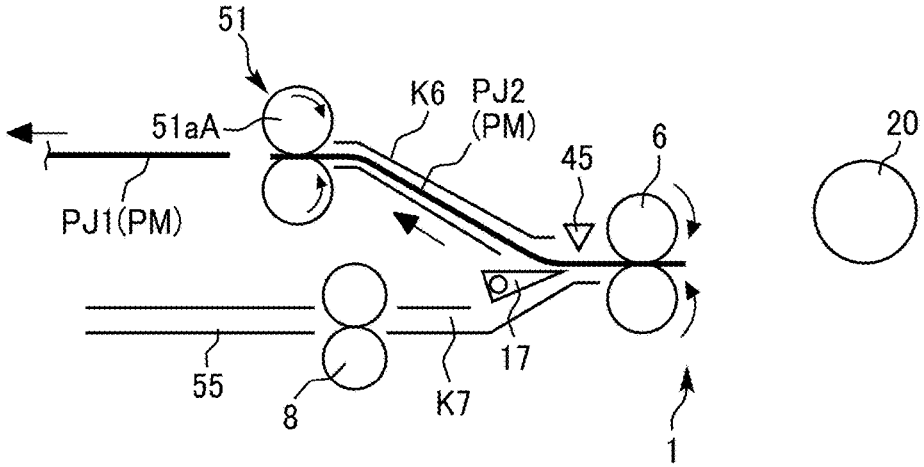

FIGS. 16A and 16B are schematic views, each illustrating a part of operations in the continuous sheet laminating operation of the sheet laminator 50, according to Variation 1.

FIGS. 16A and 16B correspond to FIGS. 10B and 10C according to the present embodiment.

As illustrated in FIGS. 16A and 16B, the configuration and functions of the sheet laminator 50 according to Variation 1 are basically identical to the configuration and functions of the sheet laminator 50 according to the present embodiment. That is, the sheet laminator 50 of Variation 1 includes a sheet lamination device 51A including a single heat-pressure roller pair, i.e., a heat-pressure roller pair 51*a*A, while the sheet laminator 50 according to the present embodiment includes the sheet lamination device 51 including three heat-pressure roller pairs (i.e., the first heat-pressure roller pair 51*a*, the second heat-pressure roller pair 51*b*, and the third heat-pressure roller pair 51*c*).

Similar to the continuous sheet laminating operation performed by the sheet laminator 50 according to the present embodiment, as illustrated in FIGS. 16A and 16B, the continuous sheet laminating operation performed by the sheet laminator 50 of Variation 1 having the above-described configuration is controlled so that the trailing end of the preceding two-ply sheet PJ1 passes the extreme upstream portion (i.e., the nip region of the heat-pressure roller pair 51*a*A) of the sheet lamination device 51A, and then the leading end of the subsequent two-ply sheet PJ2 is fed and inserted into the extreme upstream portion (i.e., the nip region of the heat-pressure roller pair 51*a*A).

Therefore, the continuous sheet laminating operation is performed in a state in which the gap (space) between the preceding two-ply sheet PJ1 and the subsequent two-ply sheet PJ2 is further reduced (narrowed). Accordingly, the time to finish the entire sheet laminating operation (series of jobs) on the plurality of two-ply sheets PJ is reduced, thereby enhancing the productivity of the sheet laminator 50.

Variation 2

Figure 17:
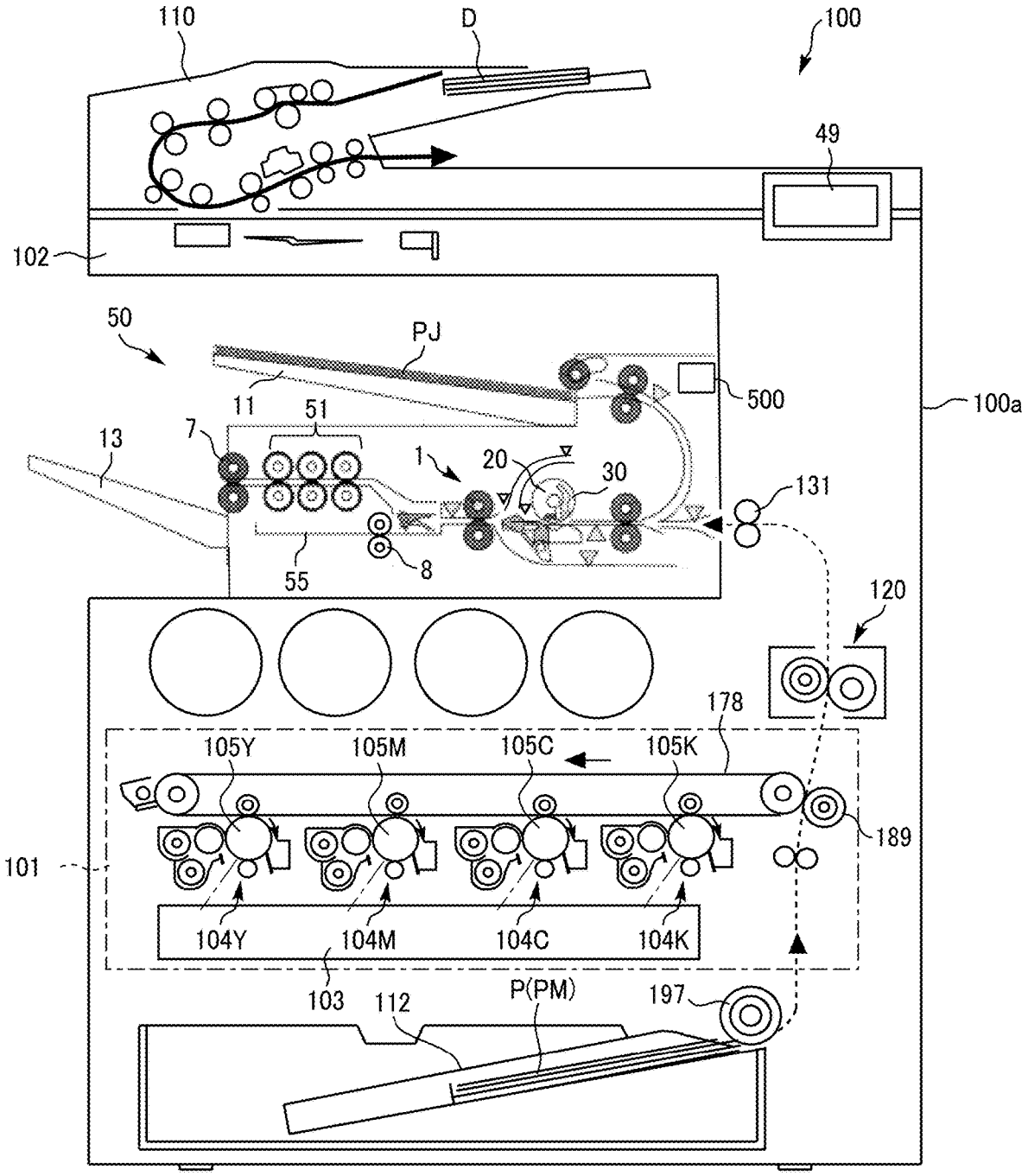
FIG. 17 is a schematic view illustrating an image forming apparatus, according to Variation 2.

A description is given of an image forming apparatus according to Variation 2, with reference to FIG. 17.

FIG. 17 is a schematic view illustrating an image forming apparatus, according to Variation 2.

As illustrated in FIG. 17, an image forming apparatus 100 according to Variation 2 that forms an image on a sheet P includes the sheet laminator 50 illustrated in FIG. 1, on a housing 100*a* of the image forming apparatus 100. The housing 100*a* holds an image forming device 101 that performs an image forming operation in the image forming apparatus 100 to form an image on a sheet such as the inner sheet PM. However, in the image forming apparatus 100, the sheet P that is fed from a sheet feeding device 112 and conveyed by the sheet feed roller 197 is conveyed as the inner sheet PM to the sheet laminator 50.

With reference to FIG. 17, in the image forming apparatus 100, multiple pairs of sheet conveying rollers disposed in a document feeder 110 feed an original document D from a document loading table and convey the original document D in a direction indicated by arrow in FIG. 17. By so doing, the original document D passes over a document reading device 102. At this time, the document reading device 102 optically reads image data of the original document D passing over the document reading device 102.

The image data optically read by the document reading device 102 is converted into electrical signals and transmitted to a writing device 103. The writing device 103 emits laser beams onto photoconductor drums 105Y, 105M, 105C, and 105K, based on the electrical signals of the image data in each of colors, respectively. By so doing, an exposure process is executed by the writing device 103.

On the photoconductor drums 105Y, 105M, 105C, and 105K of respective image forming units 104Y, 104M, 104C, and 104K, a charging process, the exposure process, and a developing process are executed to form desired images on the photoconductor drums 105Y, 105M, 105C, and 105K, respectively.

The images formed on the photoconductor drums 105Y, 105M, 105C, and 105K are transferred and superimposed onto an intermediate transfer belt 178 to form a color image. The color image formed on the intermediate transfer belt 178 is transferred onto the surface of a sheet P (which is a sheet to function as the inner sheet PM) fed and conveyed by the sheet feed roller 197 from the sheet feeding device 112 that functions as a second sheet feeder, at a position at which the intermediate transfer belt 178 faces a secondary transfer roller 189.

After the color image is transferred onto the surface of the sheet P (that is, the inner sheet PM), the sheet P is conveyed to the position of a fixing device 120. The fixing device 120 fixes the transferred color image on the surface of the sheet P, to the sheet P.

Thereafter, the sheet P is ejected from the image forming device 130 of the image forming apparatus 100 by an ejection roller pair 131, and is fed as the inner sheet PM, into the sheet laminator 50. At this time, when the sheet laminator 50 receives the inner sheet PM, the sheet laminator 50 has completed the operation described with reference to FIGS. 4A to 7C (that is, the operation to separate the two-ply sheet PJ) and performs the operation described with reference to FIGS. 8A to 8C (that is, the operation to insert the inner sheet PM into the two-ply sheet PJ) after the sheet laminator 50 receives the inner sheet PM. Further, after the sheet lamination device 51 has completed the sheet laminating operation on the two-ply sheet PJ in which the inner sheet PM is inserted, the second ejection roller pair 8 ejects the two-ply sheet PJ to the outside of the sheet lamination device 51 to stack the two-ply sheet PJ on the first ejection tray 13.

As described above, a series of image forming operations (i.e., the printing operations) in the image forming apparatus 100 and a series of sheet separating operation of the two-ply sheet PJ and the sheet laminating operation of the inner sheet PM on which the image is formed are completed.

Then, even in the image forming apparatus 100 having the above-described configuration, when the continuous sheet laminating operation is performed, the sheet separating operation is started to be performed on the subsequent two-ply sheet PJ2 while the sheet laminating operation is being performed on the preceding two-ply sheet PJ1. Accordingly, the overall productivity of the image forming apparatus 100 is enhanced.

Note that the image forming apparatus 100 further includes the operation display panel 49. When the controller 500 determines that the abnormal state occurs based on the results detected by the sixth sensor 46 that functions as an abnormality detection sensor, the controller 500 causes the operation display panel 49 to display that the occurrence of the abnormal state stops the sheet separating operation of the two-ply sheet PJ and the sheet inserting operation of the inner sheet PM.

Further, the image forming apparatus 100 according to Variation 2 of the present disclosure is a color image forming apparatus but may be a monochrome image forming apparatus. Further, the image forming apparatus 100 according to Variation 2 of the present disclosure employs electrophotography, but the present disclosure is not limited to an electrophotographic image forming apparatus. For example, the present disclosure may be applied to other types of image forming apparatuses such as an inkjet image forming apparatus and a stencil printing machine.

Variation 3

Figure 18:
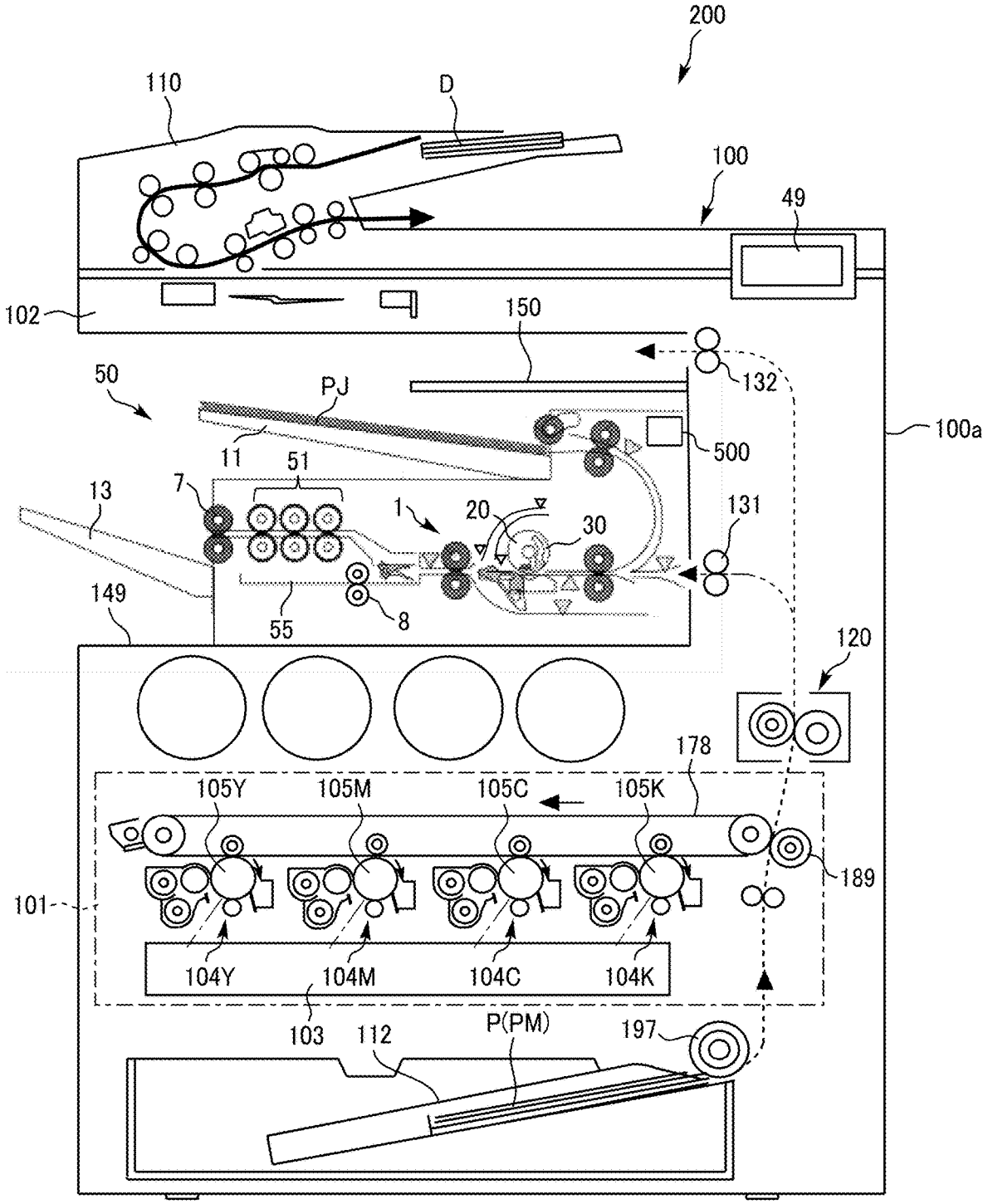
FIG. 18 is a schematic view illustrating an image forming system, according to Variation 3.

A description is given of an image forming system according to Variation 3, with reference to FIG. 18.

As illustrated in FIG. 18, an image forming system 200 according to Variation 3 includes the image forming apparatus 100 the sheet laminator 50.

In the image forming system 200, the image forming apparatus 100 includes the image forming device 101 disposed in the housing 100*a*, and the sheet laminator 50 includes the sheet separation device 1 and the sheet lamination device 51. The sheet laminator 50 is detachably attached to the housing 100*a* of the image forming apparatus 100. As in the image forming apparatus 100 of Variation 2, the sheet P that is fed from the sheet feeding device 112 and conveyed by the sheet feed roller 197 is conveyed as the inner sheet PM to the sheet laminator 50 in the image forming apparatus 100 of Variation 3.

In the image forming system 200 illustrated in FIG. 18, the image forming apparatus 100 performs the image forming operations on the sheet P, as described above with reference to FIG. 17. Then, the image forming apparatus 100 ejects the sheet P (that is, the inner sheet PM on which a desired image is formed) from the ejection roller pair 131 to the sheet laminator 50. Then, after the sheet P is conveyed to the sheet laminator 50, the sheet P is inserted into the two-ply sheet PJ, where the sheet laminator 50 performs the sheet laminating operation on the two-ply sheet PJ. Then, the first ejection roller pair 7 ejects the two-ply sheet PJ to the outside of the sheet laminator 50 to stack the two-ply sheet PJ on the first ejection tray 13.

Then, even in the image forming apparatus 100 having the above-described configuration, when the continuous sheet laminating operation is performed, the sheet separating operation is started to be performed on the subsequent two-ply sheet PJ2 while the sheet laminating operation is being performed on the preceding two-ply sheet PJ1. Accordingly, the overall productivity of the image forming apparatus 100 is enhanced.

When the above-described sheet laminating operation is not performed, the image forming apparatus 100 of the image forming system 200 according to Variation 3 ejects the sheet P having the image formed in the image forming operations, from a second ejection roller pair 132 to the outside of the image forming apparatus 100, so as to stack the sheet P on a second ejection tray 150.

As described above, the sheet laminator 50 is detachably attached to the housing 100*a* of the image forming apparatus 100. When the sheet laminator 50 is not used, the sheet laminator 50 may be detached from the image forming apparatus 100. In a case in which the sheet laminator 50 is removed from the image forming apparatus 100, a placement surface 149 on which the sheet laminator 50 was installed functions as an ejection tray, and the sheet P that is ejected from the ejection roller pair 131 to the outside of the image forming apparatus 100 is stacked on the placement surface 149, in other words, the sheet P on which a desired image is formed is stacked on the placement surface 149.

As described above, the sheet laminator 50 according to the present embodiment includes the sheet separation device 1 that performs the sheet separating operation and the sheet inserting operation. To be more specific, the sheet separation device 1 performs the sheet separating operation to separate the non-bonding portion of the two-ply sheet PJ in which two sheets, which are the first sheet P1 and the second sheet P2, are overlapped and bonded together at one end of the two-ply sheet PJ as the bonding portion A of the two-ply sheet PJ. The sheet separation device 1 then performs the sheet inserting operation to insert the inner sheet PM between the first sheet P1 and the second sheet P2 separated from each other by the sheet separating operation. The sheet laminator 50 according to the present embodiment further includes the sheet lamination device 51 that performs the sheet laminating operation on the two-ply sheet PJ after the sheet separating operation and the sheet inserting operation are performed on the two-ply sheet PJ by the sheet separation device 1. Then, in a case in which the sheet laminator 50 performs the sheet laminating operation on the plurality of two-ply sheets PJ including the preceding two-ply sheet PJ1 and the subsequent two-ply sheet PJ2, when the sheet lamination device 51 is performing the sheet laminating operation on the preceding two-ply sheet PJ1, the sheet separation device 1 that performs the sheet separating operation and the sheet inserting operation performs at least the sheet separating operation on the subsequent two-ply sheet PJ2.

Accordingly, the sheet laminator 50 of the image forming apparatus 100 achieves the enhanced productivity in the sheet laminating operation on the plurality of two-ply sheets, e.g., the first sheet P1 and the second sheet P2.

Note that, in the present embodiment, the first branched sheet conveyance passage K4 and the second branched sheet conveyance passage K5 branch off in different directions from the third sheet conveyance passage K3 (sheet conveyance passage) between the separation claws 16 each functioning as a separator and the winding roller 20. By contrast, the first branched sheet conveyance passage K4 and the second branched sheet conveyance passage K5 may branch off at the position of the separation claws 16 (each functioning as a separator) in different directions from the third sheet conveyance passage K3 (sheet conveyance passage), resulting that the third sheet conveyance passage K3 is interposed between the first branched sheet conveyance passage K4 and the second branched sheet conveyance passage K5.

Further, in the present embodiment, the first branched sheet conveyance passage K4 and the second branched sheet conveyance passage K5 are formed in a substantially U shape extending from the branch portion to the right side of FIG. 2. However, the shape of the first branched sheet conveyance passage K4 and the second branched sheet conveyance passage K5 is not limited to the above-described U shape. For example, the first branched sheet conveyance passage K4 and the second branched sheet conveyance passage K5 may be formed in a substantially U shape extending from the branch portion to the left in FIG. 2 or may be formed in a substantially S shape extending from the branch portion to both the left and right in FIG. 2.

Further, even when the above-described sheet separation devices are applied, these sheet separation devices achieve the same effect as the effect provided by the configuration(s) in the present embodiment.

Note that embodiments of the present disclosure are not limited to the above-described embodiments and it is apparent that the above-described embodiments can be appropriately modified within the scope of the technical idea of the present disclosure in addition to what is suggested in the above-described embodiments. Further, features of components of the embodiments, such as the number, the position, and the shape are not limited the embodiments and thus may be preferably set.

Note that, in the present disclosure, the "end surface" of the two-ply sheet is defined as a side surface extending in the thickness direction and connecting the front surface and the back surface of the two-ply sheet. Accordingly, there are four end surfaces of the rectangular two-ply sheet on the front, back, left, and right.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet laminator comprising:

a sheet separation device configured to perform:

a sheet separating operation to separate a non-bonding portion of a two-ply sheet in which two sheets are overlapped and bonded together at one end as a bonding portion of the two-ply sheet; and a sheet inserting operation to insert an inner sheet between the two sheets separated from each other by the sheet separating operation;

a sheet lamination device configured to perform a sheet laminating operation on the two-ply sheet after the sheet separating operation and the sheet inserting operation performed by the sheet separation device; and circuitry configured to cause the sheet lamination device to perform the sheet laminating operation on the two-ply sheet while causing the sheet separation device to perform the sheet separating operation on another two-ply sheet subsequent to the two-ply sheet or the sheet separating operation and the sheet inserting operation on said another two-ply sheet.

2. The sheet laminator according to claim 1, further comprising:

a sheet conveyance passage from the sheet separation device to the sheet lamination device;

a retract sheet conveyance passage from the sheet separation device to a retract portion; and a switcher configured to switch a state of the sheet conveyance passage and the retract sheet conveyance passage, between a first state in which the sheet conveyance passage is open and the retract sheet conveyance passage is closed and a second state in which the sheet conveyance passage is closed and the retract sheet conveyance passage is open.

3. The sheet laminator according to claim 1, further comprising:

a sheet conveyance passage from the sheet separation device to the sheet lamination device; and a sheet sensor disposed on the sheet conveyance passage.

4. The sheet laminator according to claim 1, wherein the circuitry is configured to cause a leading end of said another two-ply sheet in a sheet conveyance direction to enter an extreme upstream portion of the sheet lamination device in the sheet conveyance direction after a trailing end of the two-ply sheet in the sheet conveyance direction passes the extreme upstream portion of the sheet lamination device.

5. The sheet laminator according to claim 4, wherein the sheet lamination device includes a plurality of heat-pressure roller pairs aligned along the sheet conveyance direction, the plurality of heat-pressure roller pairs being configured to apply heat and pressure to the two-ply sheet, and wherein the extreme upstream portion of the sheet lamination device is a nip region of an extreme-upstream heat-pressure roller pair of the plurality of heat-pressure roller pairs in the sheet conveyance direction.

6. The sheet laminator according to claim 4, wherein the sheet lamination device includes a heat-pressure roller pair configured to apply heat and pressure to the two-ply sheet, and wherein the extreme upstream portion of the sheet lamination device is a nip region of the heat-pressure roller pair.

7. The sheet laminator according to claim 1, further comprising:

a winding roller configured to rotate in a predetermined rotational direction to wind the two-ply sheet;

a conveyance roller pair configured to convey the two-ply sheet with an opposite end opposite the one end being, as a leading end, toward the winding roller in a sheet conveyance passage between the winding roller and the conveyance roller pair;

a separator configured to insert into a gap formed in the non-bonding portion between the two sheets of the two-ply sheet at a position between the winding roller and the conveyance roller pair, in a state in which the two-ply sheet is wound from the opposite end of the two-ply sheet by the winding roller and the one end of the two-ply sheet is nipped by the conveyance roller pair;

two branched sheet conveyance passages branching off in different directions from the sheet conveyance passage interposed between the two branched sheet conveyance passages; and a switcher configured to guide the two sheets separated by the separator, to the two branched sheet conveyance passages, respectively.

8. An image forming apparatus comprising:

a housing including an image forming device configured to form an image on a sheet; and the sheet laminator according to claim 1.

9. An image forming system comprising:

an image forming apparatus configured to form an image on a sheet; and the sheet laminator according to claim 1, detachably attached to the image forming apparatus.

* * * * *